US006083047A

United States Patent [19]

Paagman

[11] Patent Number: 6,083,047

[45] Date of Patent: Jul. 4, 2000

[54] MODULAR ELECTRICAL PCB ASSEMBLY CONNECTOR

[75] Inventor: Bernardus L. F. Paagman, Schijndel, Netherlands

[73] Assignee: Berg Technology, Inc., Reno, Nev.

[21] Appl. No.: 08/784,743

[22] Filed: Jan. 16, 1997

[51] Int. Cl.[7] ..... H01R 13/648

[52] U.S. Cl. ..... 439/608

[58] Field of Search ..... 439/610, 608, 439/79

[56] References Cited

U.S. PATENT DOCUMENTS

| | | | |
|---|---|---|---|
| 4,338,717 | 7/1982 | Damon | 29/839 |
| 4,571,014 | 2/1986 | Robin et al. | 439/108 |
| 4,689,721 | 8/1987 | Damerow et al. | 361/388 |
| 4,705,332 | 11/1987 | Sadigh-Behzadi | 439/69 |
| 4,806,107 | 2/1989 | Arnold et al. | 439/79 |
| 4,861,272 | 8/1989 | Clark | 439/79 |
| 4,975,084 | 12/1990 | Fedder et al. | 439/608 |
| 5,055,069 | 10/1991 | Townsend et al. | 439/608 |
| 5,066,236 | 11/1991 | Broeksteeg | 439/79 |
| 5,104,341 | 4/1992 | Gilissen et al. | 439/608 |
| 5,122,065 | 6/1992 | Dudek et al. | 439/76.1 |
| 5,174,770 | 12/1992 | Sasaki et al. | 439/607 |
| 5,454,738 | 10/1995 | Lim et al. | 439/676 |
| 5,460,533 | 10/1995 | Broeksteeg et al. | 439/608 X |
| 5,470,244 | 11/1995 | Lim et al. | 439/189 |
| 5,522,727 | 6/1996 | Saito et al. | 439/65 |
| 5,605,477 | 2/1997 | Wu et al. | 439/620 |
| 5,664,968 | 9/1997 | Mickievicz | 439/608 |

FOREIGN PATENT DOCUMENTS

| | | |
|---|---|---|
| 0 442 643 A3 | 8/1991 | European Pat. Off. . |
| 0 752 739 A1 | 1/1997 | European Pat. Off. . |
| 97/02627 | 7/1996 | WIPO . |

OTHER PUBLICATIONS

"Field–Based Design of a New High Pincount Board Connector for High Data Transmission" By H. Katzier, B.–M Keller, Peter Pagnin, Dirk Michel, 1996 Electronic Components and Technology Conference, pp. 456–459, publication date May 28, 1996.

*Primary Examiner*—Michael L. Gellner
*Assistant Examiner*—Barry M. L. Standig
*Attorney, Agent, or Firm*—Brian J. Hamilla; M. Richard Page

[57] ABSTRACT

An electrical connector formed from a plurality of modules. The connector relays differential pairs of signals, with the signal conductors that define each of the differential pairs residing on different modules in a twin-ax configuration. The modules can include one or more circuit substrates. The conductors on adjacent circuit substrates can have a mirror image relationship.

37 Claims, 20 Drawing Sheets

30
62
37
56

62
37
48
VIID
VIID
35
59
69
VIIC
VIIC
VIIB
VIIA
VIIB
VIIA
34
58
57

57
38
31
34
58

63
31
64
65
66

63
59
31
35
65
60

MODULAR ELECTRICAL PCB ASSEMBLY CONNECTOR

BACKGROUND OF THE INVENTION

1. Field of the Invention

The present invention relates to connectors and specifically to high speed, shielded connectors having one or more integrated PCB assemblies.

2. Brief Description of Prior Developments

Connectors, having insulative bodies and individual metal terminals are now widely used and available in many different configurations. For most connector structures the usual method of manufacture comprises stitching or insert molding terminals into a suitable housing. The manufacturing process may also include a terminal tail bending operation, especially for right angle connectors. Connectors for high-frequency applications present additional requirements. In this regard, controlled-impedance terminal sections with ground shielding options are preferred. Towards this end, it is known to subdivide the manufacture of such a connector into one part for accommodating contact terminals for mating contact with the contact terminal of a mating connector and a separate part for the tail end. Separate shielding casings, if required in a right angled configuration, may be provided around each of the terminals within the connector. Although connectors manufactured as described above operate satisfactorily, the manufacturing costs are high.

U.S. Pat. No. 4,571,014 shows a different approach for making backplane connectors using one or more PCB assemblies. Each of the PCB assemblies comprises one insulated substrate, one spacer, and one cover plate, all of which are attached to one another. The insulating substrate is provided with a predetermined pattern of conducting tracks, while ground tracks are provided between the conducting tracks. The conducting tracks are connected at one end to a female contact terminal and at the other end to a male contact terminal. Each of the cover plates is a conductive shield member.

In the arrangement according to U.S. Pat. No. 4,571,014, the circuit substrates are arranged with the sides bearing the conductive tracks all facing in the same direction. The cover plates/shields are each interleaved between adjacent substrates. While such an arrangement produces a plurality of individual shielded tracks, it does not present the possibility for creating impedance matched pairs of conductive tracks through the connector, in a twinax configuration. Twinax connectors are often utilized in combination with twisted pair cable. Such twisted pair cables usually have a plurality of pairs of identical conductors twisted along the signal transmission length. Such a conductor pair has the signal over the two conductors as differential pair; this conductor pair (and possibly several twisted pairs) is enclosed within an outer copper shielding braid to form a cable. Often each twisted pair may have an individual drain wire. Because the electromagnetic flux generated on the twisted pair of a conductor are equal in magnitude and opposite in direction, effectively they cancel each other. Extending this concept to a pair of twinax connector contacts, this can be envisaged as two adjacent, spaced contact elements contained within an outer (rectangular cross-section) grounding shell. This is a relatively inexpensive method to maintain signal quality through an interconnection. Often this is referred to a "balanced pair" interconnection. Use of such twinax interconnection termination is often related to the use of cable, but similarly a twinax connector may be terminated on a PCB. In the latter case, instead of the cable twisting, the connector can be mounted on a PCB having pairs of identical tracks which are located spatially adjacent to each other, usually as part of a multi-layered structure.

Further, U.S. Pat. No. 4,571,014 discloses primarily a backplane interconnection and not a cable-to-cable or cable-to-board interconnection.

Published European Patent No. 0 442 643 discloses a cable connector formed of a plurality of shielded PCB assemblies. However, this connector does not use mirror image PCB orientation for forming twinax connectors. Further, this design utilizes a metal shield that envelops each PCB assembly.

PCT Patent Application Ser. No. US96/11214 filed Jul. 2, 1996 (the disclosure of which is incorporated therein by reference) discloses board to board connectors made from stacked modules, each module being formed of a printed circuit board assembly and a cover. This application discloses high speed board to board connectors that have relatively low manufacturing costs.

SUMMARY OF THE INVENTION

The object of the present invention is to provide a connector which overcomes the disadvantages described above.

This object is obtained by the present invention by providing a connector in which connector terminals are associated with conductive tracks or traces on a PCB adapted to function as conductive leads of the connector. PCB's are arranged to provide pairs of electrically matched conductive traces, by placing traces in a substantially mirror-image relationship.

In order to provide shielding for matched pairs of conducting tracks on the PCB, ground tracks may be provided between the conducting tracks on a first surface and a ground layer may be provided on a second surface opposite the first surface.

The covers are made of insulating material and may hold one or more insulating substrates with conductive traces in opposed relationship to form matched pairs of conductive traces. The covers, together with one or more associated PCB's, may form modules that are assembled in side-by-side relationship in a housing to form a completed connector.

The connector may also comprise an insulating connector body accommodating each of said one or more integrated PCB assemblies and provided with a metallized shielding layer on its outer surface. Thereby, the electromagnetic interference caused by such a connector to the environment is further reduced. The connector body desirably includes structure for receiving and securing PCB modules in alignment.

According to another feature of the invention, the PCB modules include structure for retaining flexible conductors, such as wires or cables, in a position to be secured to traces on the PCB. The covers can include such retaining structures.

BRIEF DESCRIPTION OF THE DRAWINGS

The present invention will be further illustrated with reference to the drawings which are meant for illustration purposes only and not intended to limit the scope of the present invention.

In the drawings.

DETAILED DESCRIPTION OF THE PREFERRED EMBODIMENTS

Figure 1A:
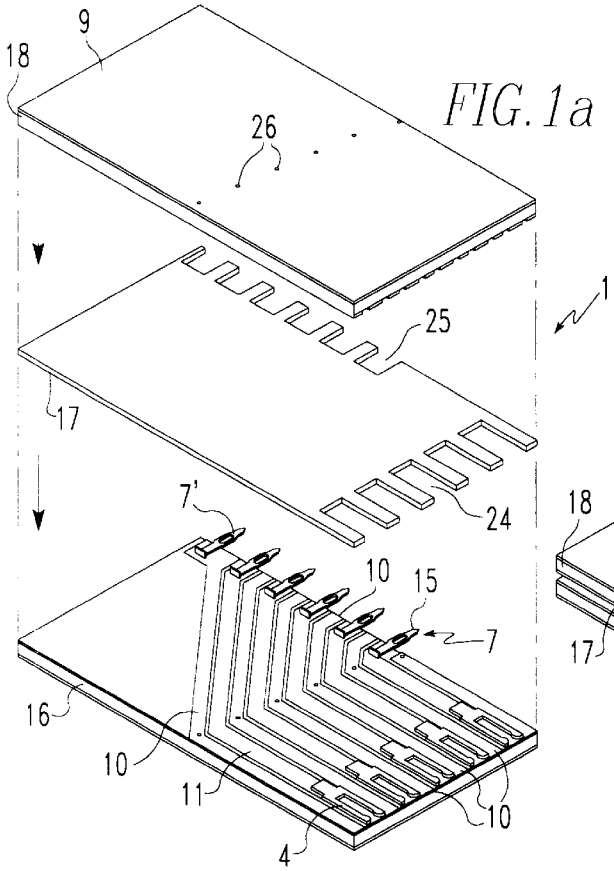
FIGS. 1*a*–1*c* show construction techniques broadly applicable to connectors embodying the invention.
Figure 1B:
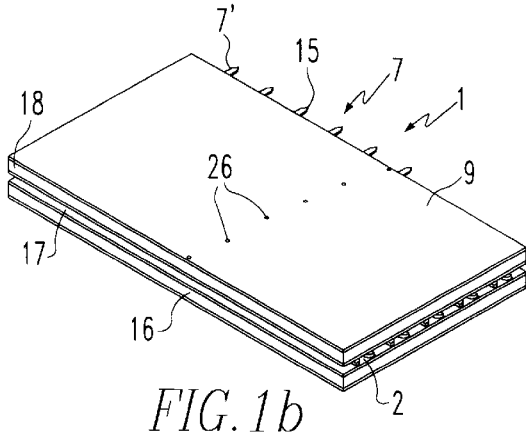
Figure 1C:
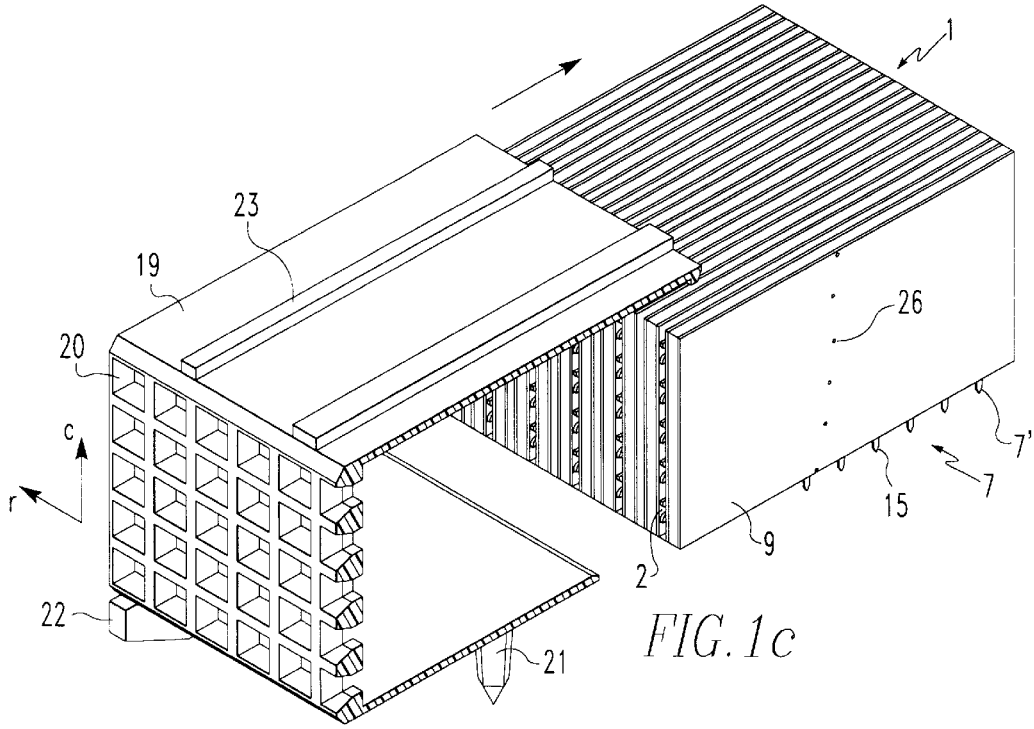

FIGS. 1*a*–1*c* generally show manufacturing steps for producing a right angle connector according to the invention in which standard methods of producing printed circuit boards are used.

FIG. 1*a* shows an insulating substrate 16, formed for example of conventional flat PCB material provided with several parallel conducting signal tracks 11. Conducting ground tracks 10 may be provided between adjacent tracks 11. The outer most conducting ground track 10 is provided with a ground contact terminal 7 to be connected to ground through the printed circuit board on which the connector is to be mounted. Methods of producing an insulating substrate 16 with parallel conducting tracks 10, 11 are widely known in the field of manufacturing printed circuit boards and need not be explained here.

Each of the conducting tracks 11 is connected to board contact terminals 7, the board contact portions 15 of which extending beyond the circuit substrate 16. Although the board contact portions 15 are shown as press-fit terminals they might be replaced by suitable solder tail terminals. The other ends of the conducting tracks 11 are connected to suitable contact terminals 4. Preferably, the terminals 4 and 7, respectively are fixed onto suitable solder pads formed at the ends of traces 11. This can be achieved by conventional surface mount soldering techniques.

An insulating spacer 17 can be provided having a first series of openings 24 for accommodating the contact terminals 4 and a second series of openings 25 for accommodating at least part of the board contact terminals 7. The recess 2 in the module 1 is formed at the interface of adjacent layers or laminations. That is, the recesses 2, for example, are bounded by the circuit substrate 16, the edges of openings 24 or 25 and the cover 18. This allows the contacts to be secured on substrate 16 by conventional surface mounting or other bonding techniques.

An insulating cover 18, optionally provided with a fully metallized ground layer 9, overlies the circuit substrate 16. Preferably, the cover 18 and spacer 17 are combined into a single molded part.

FIG. 1*b* shows one integrated PCB assembly manufactured from the components shown in FIG. 1*a*, i.e. an insulating substrate 16 to which an insulating spacer 17 is attached and an insulating cover plate 18 attached to the insulating spacer 17. The first series of openings 24 in the insulating spacer 17 form recesses 2, in which the receptacle terminals 4 are disposed to receive contact terminals of a mating connector (not shown). It is to be understood that the receptacle terminals 4 shown in FIG. 1*a* may be replaced by pins or hermaphrodite contact terminals.

As previously mentioned, instead of providing both a spacer and a cover plate 18, only a cover plate could be provided in which suitable recesses are made for accommodating the contact terminals 4 and the board contact terminals 7. Such recesses would serve the same purpose as openings 24, 25 in spacer 17 shown in FIG. 1*a*. Alternatively, but less desirably from a cost standpoint, such recesses could be provided in substrate 16.

FIG. 1*c* shows several integrated PCB modules as shown in FIG. 1*b* arranged parallel, side-by-side relationship for insertion into a connector body 19. The connector body 19 may be made of any insulating material and may be provided with a metallized inner surface to enhance the shielding effectiveness. The connector body 19 may be provided with suitable guiding ridges 23 and one or more guiding extensions 22 for properly connecting the assembled connector to a mating connector (not shown).

As is conventional, one or more locating and securing posts 21, receivable within a hole in a printed circuit board to which the connectors to be connected, is provided at the bottom side of the connector body 19.

The connector body 19 is provided with suitable lead-in holes 20 in corresponding relationship with each of the contact terminals 4. Each of the lead-in holes 20 is suitable for receiving a mating pin terminal of a mating connector (not shown). The lead-in holes 20 are arranged in columns and rows as is designated by arrows c and r.

Figure 2:
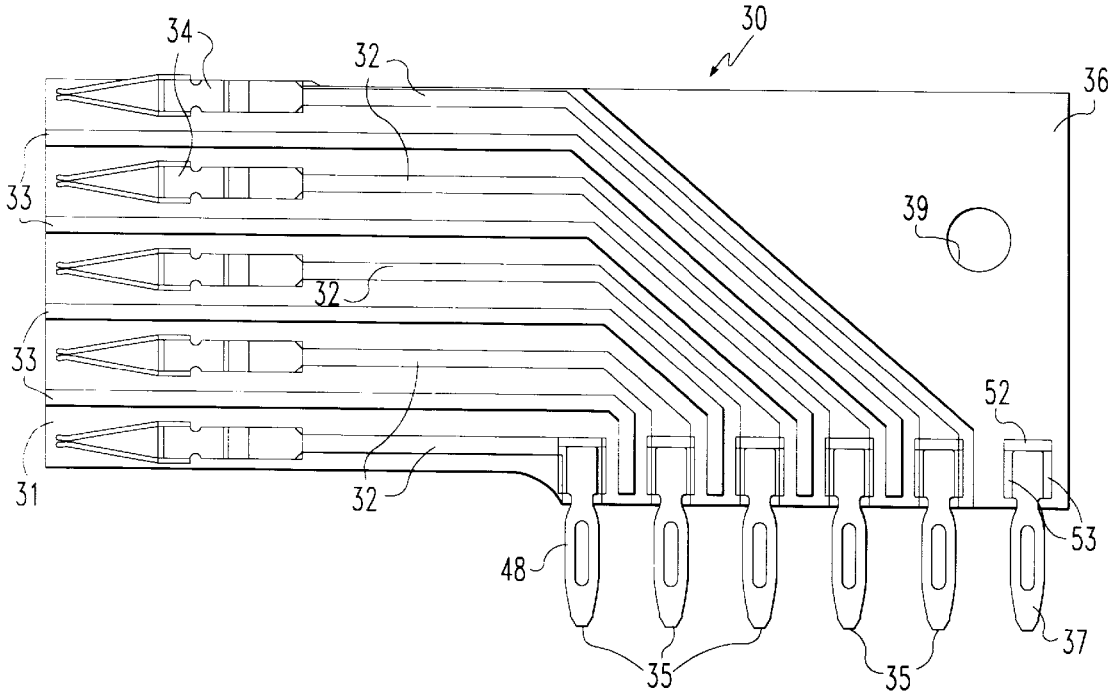
FIG. 2 is a side elevational view of a PCB assembly according to one embodiment of the invention.

Referring to FIG. 2, the PCB assembly 30 comprises an insulating substrate 31 of a material commonly commercially used for making PCBs. The substrate 31 can be a resin impregnated fiber material, such as is sold under the designation FR4, having a thickness 0.4 mm, for example. On a first surface of the substrate 31, a plurality of signal traces 32 are formed by conventional PCB techniques. Each trace 32 extends from a first portion of the substrate 31, for example adjacent the front edge as shown in FIG. 2, to a second area or region of the substrate 31, such as the bottom edge as shown in FIG. 2. The traces 32 include contact pads at each end adapted to have metal terminals secured to them, as by conventional surface mounting techniques using solder. A plurality of ground or shielding traces 33 are also be applied to the substrate 31. The shielding traces 33 are preferably disposed between each of the circuit traces 32. A terminal, such as a contact terminal 34 is mounted at the first end of each trace 32 and a connector mounting side terminal 35 is mounted on the second end of each circuit trace 32. An additional shielding or ground layer 36 may be applied to the remainder of the substrate 31. A ground terminal 37 is fixed onto the ground layer 36, in alignment with the terminals 35.

A locating hole 39 may be appropriately placed in the substrate 31. The locating hole 39 preferably comprises a plated through hole for establishing electrical connection with a grounding layer 38 (FIG. 5) that may extend substantially over the entire back surface of the substrate 31. Small vias forming plated through-holes (not shown in FIG. 2) may be disposed in each of the ground tracks 33 so that the ground tracks 33, the shield layer 36 and the back shield layer 38 form a shielding structure for the signal traces 32 and associated terminals. If no shielding or limited shielding is desired, one or more of the shielding structures 33, 36 or 38 can be eliminated.

Figure 3:
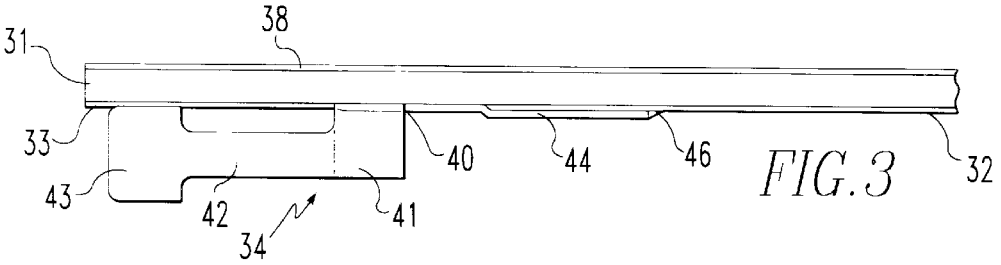
FIGS. 3, 4 and 5 are fragmentary views showing the mounting of terminals on the PCB assembly shown in FIG. 2.
Figure 4:
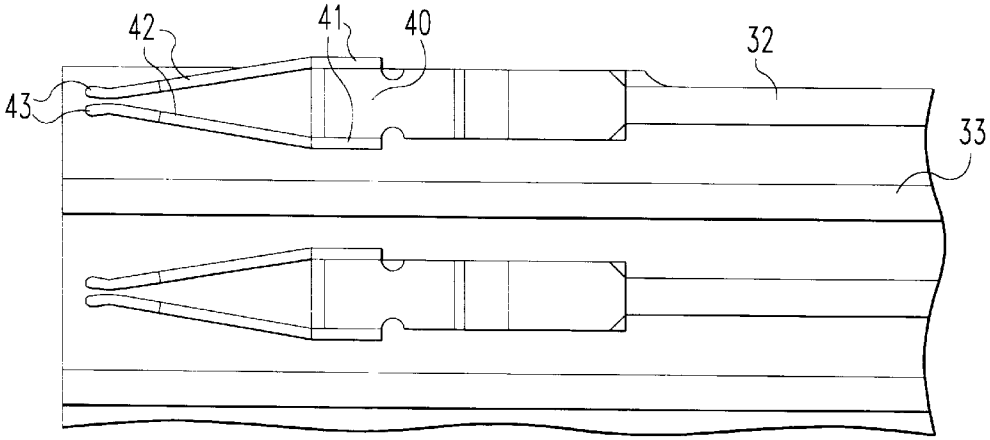

As shown in the fragmentary views of FIGS. 3 and 4, contact terminals 34 are formed as a one-piece stamping and can comprise a dual beam contact having a base section 40 having an opposed pair of upstanding portions 41. A spring section 42 is cantilevered from each of the upstanding portions 41 to define an insertion axis for a mating terminal, such as a pin from a pin header. Such a mating pin would engage the contact portions 43 disposed at the end of each cantilevered arm 42. The contact terminals also include a mounting section, such as the planar member 44, that is adapted to be secured onto the end of the circuit trace 32, typically by solder 46. The latter can be accomplished by conventional surface mounting or other bonding techniques. As can be realized by the above description, the cantilevered arms 42 and contact portions 43 define a contact mating or pin insertion axis that is generally parallel to the plane of substrate 31, but is offset from the surface carrying the conductive traces 32.

Figure 5:
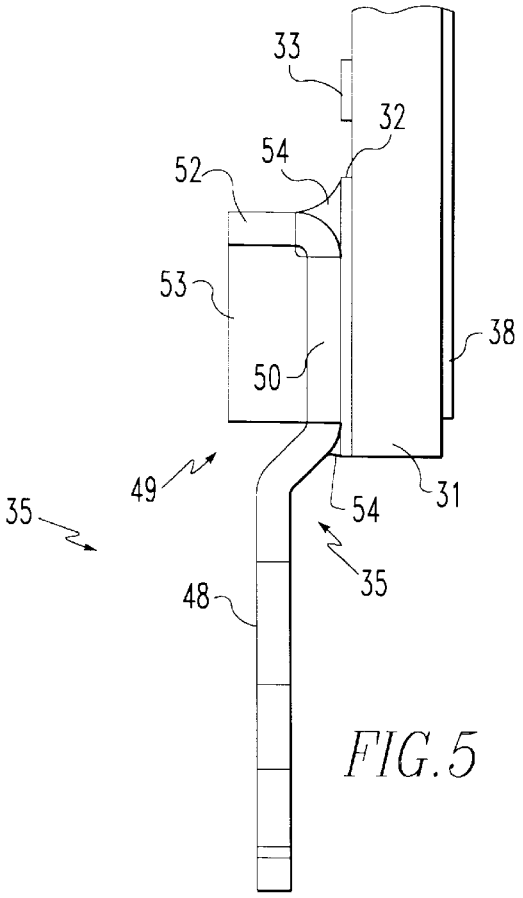
Figure 6D:
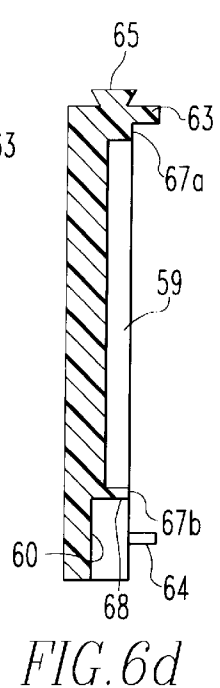
FIGS. 6–6*d* show different views of an insulative cover to be used in conjunction with the PCB assembly of FIG. 2 to form a terminal column module.
Figure 6C:
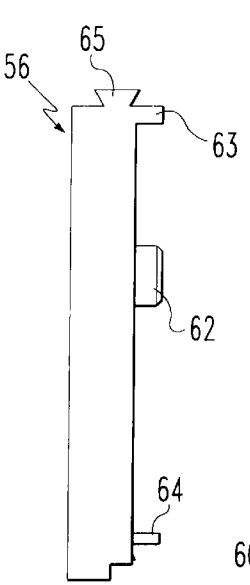
Figure 6:
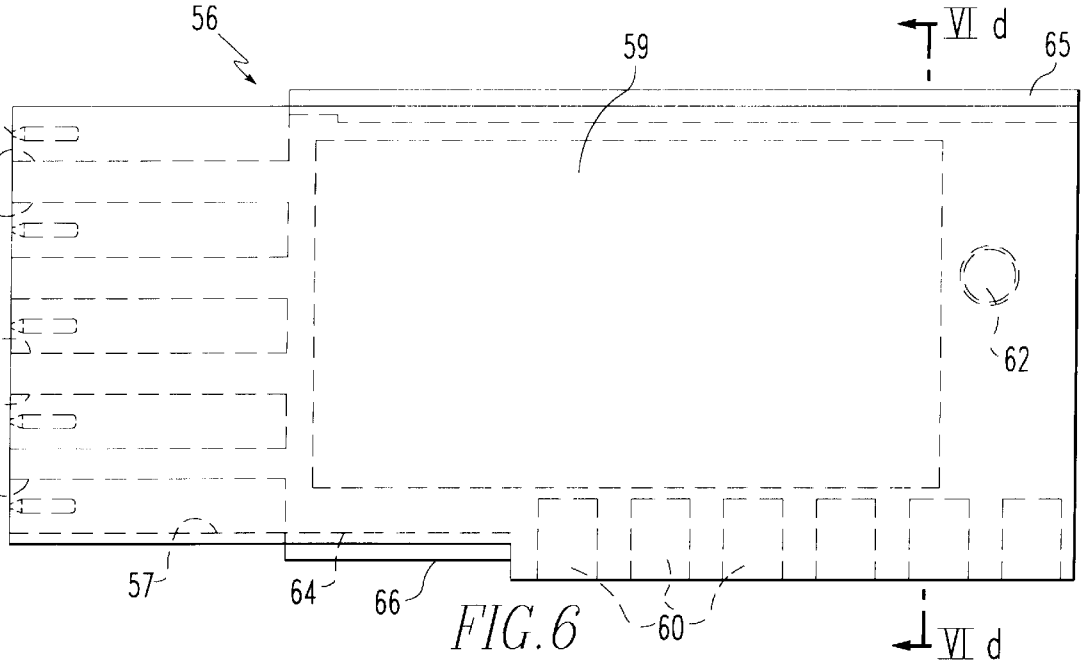
Figure 6B:
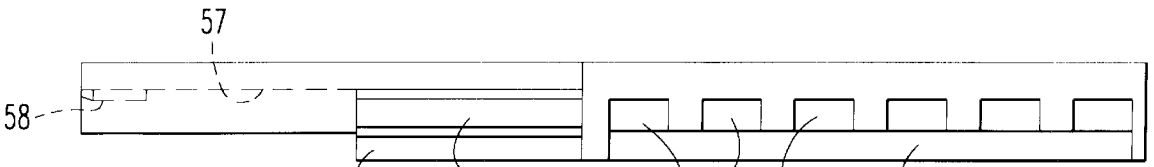
Figure 6A:
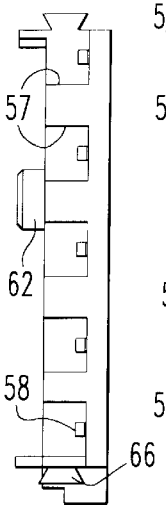

As illustrated in FIG. 5, one preferred form of connector mounting terminal 35 includes a press-fit section 48 and a board mounting section 49. The board mounting section 49 includes a generally planar base 50 with an upturned top tang 52 disposed along a top edge. A pair of opposed side tangs 53 are also upturned from the base 50. The mounting portion 49 is retained on the circuit trace 32 by solder fillets 54, again formed by conventional surface mounting solder techniques. Preferably, the top tang 52 is spaced closely adjacent to or rests on the top surfaces of the side tangs 53 as shown in FIG. 5.

FIGS. 6, 6*a*, 6*b*, 6*c* and 6*d* illustrate an insulative cover/spacer member 56, preferably molded from an appropriate polymeric insulating material. The cover includes a plurality of contact recesses 57 formed along one edge. Each of the recesses 57 includes a contact preload rib 58. A large central recess 59 may also be formed in the cover. A second plurality of terminal recesses 60 is formed along a second edge of the cover. Further, a locating boss 62 is integrally formed with the cover and is sized and shaped to be received, with limited clearance, in the locating opening 39 in the substrate 31. The cover further includes an upper rim 63 extending from the rear of the cover to a location near the recesses 57. A bottom rim or support member 64 is formed on a portion of the bottom surface of the cover. The cover 56 further includes an upper locating and mounting rib 65, preferably in the form of a dove tail rib as shown. A similar but shorter mounting and locating rib 66 is disposed on the bottom edge of the cover. The surfaces 67*a* and 67*b* form board rest surfaces against which a substrate 31 is placed. The surfaces 67*a* and 67*b* may carry an adhesive or alternately a double sided adhesive coated film (not shown) may be applied to extend from surface 67*a* to surface 67*b*.

Figures 7, 7A, 7B, 7C, 7D, 7E:
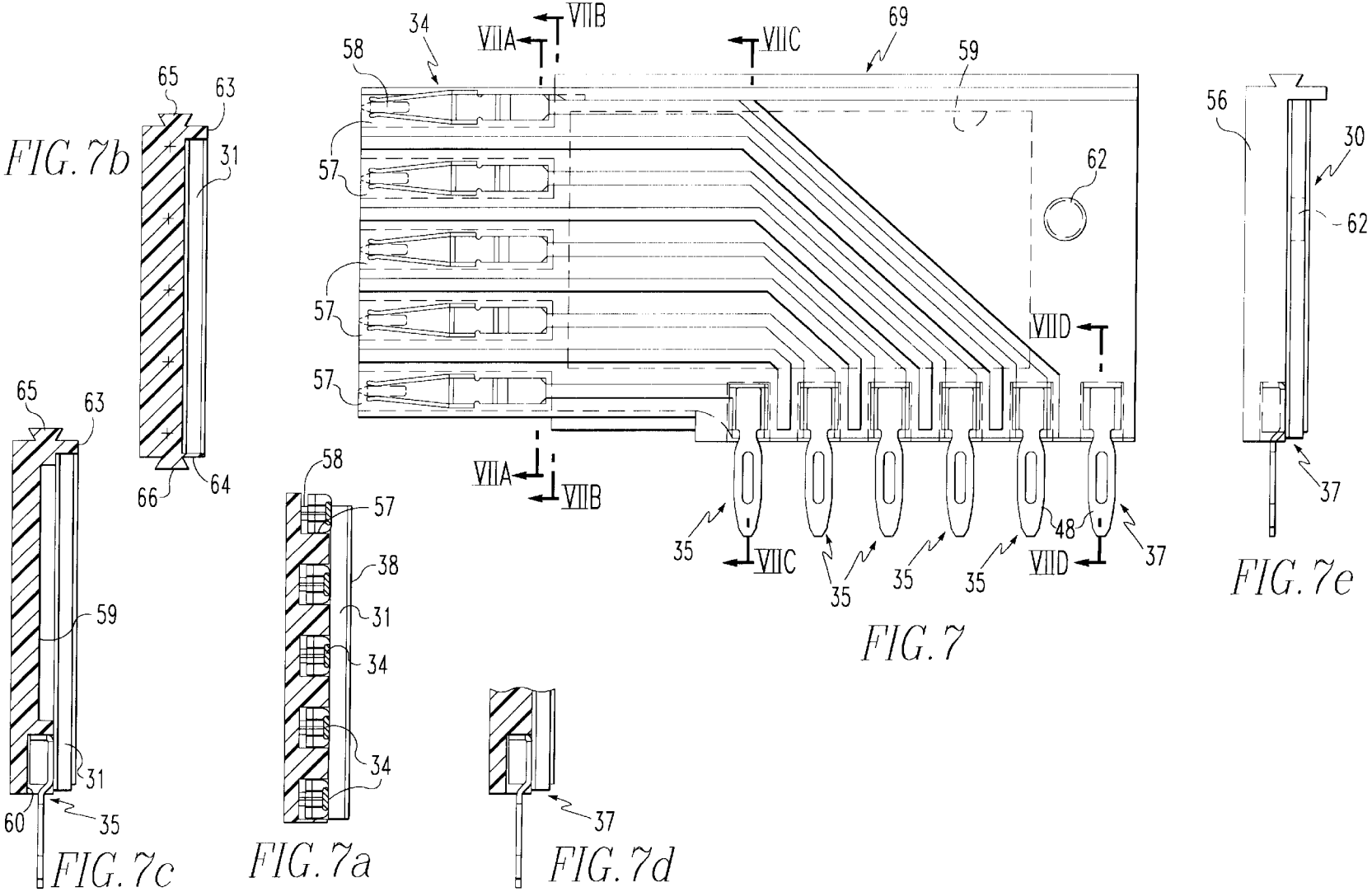
FIGS. 7–7*e* illustrate an assembled terminal module formed of a PCB assembly as shown in FIG. 2 and a cover as shown in FIG. 6.

It is noted that a half of one type of twinax contact module may be formed by associating a PCB assembly 30 with a cover 56 to form a module 69. FIG. 7 is substantially an x-ray view through the cover 56 of column terminal module 69. For ease in showing the location of the elements on substrate 31, with respect to features of the cover 56, the conductive traces and terminals are rendered in full line rather than phantom view. The PCB assembly 30 is located in the vertical direction by the upper and lower rim or mounting members 63, 64 and is located in a longitudinal manner by the locating boss 62 (see also FIG. 7*e*). The contact terminals 34 are located in the contact recesses 57 and the connector mounting terminals 35 are located in the recesses 60. The previously mentioned adhesive or adhesive coated films on surface 67*a* and 67*b* maintain the PCB assembly and cover 56 together.

FIG. 7*a* is a sectional view taken along line AA of FIG. 7 and shows the contact terminals 34 located in the contact recesses 57. The terminals 34 are positioned so that the contact portions 43 bear against the preload ribs 58 to impart a desired preload on the cantilevered spring arms 42.

FIG. 7*b* is a sectional view taken along line BB of FIG. 7. As shown in FIG. 7*b*, the substrate 31 is essentially located in a vertical position by the rims 63 and 64.

As illustrated in FIG. 7*c*, each connector mounting terminal 35 has its mounting portion received within a corresponding recess 60. If the board mounting terminal is of a type that is likely to have a relatively high axial force applied to it, such as a press-fit terminal, the surface 68 (FIG. 6*d*) of the recess 60 is advantageously located so that it bears against the upturned tang 52 of the terminal. The views in FIG. 7*c* and FIG. 9 (discussed below) are taken substantially along section line cc of FIG. 7.

FIG. 7*d* is a fragmentary cross sectional view taken along line DD of FIG. 7, showing the positioning of grounding terminal 37 in a similar fashion to terminals 35 shown in FIG. 7*c* and FIG. 9 (discussed below).

FIG. 7*e* is a view of the back end of the module 69 showing in phantom views the locating boss 62 and the mounting portion of terminal 37.

Figure 8A:
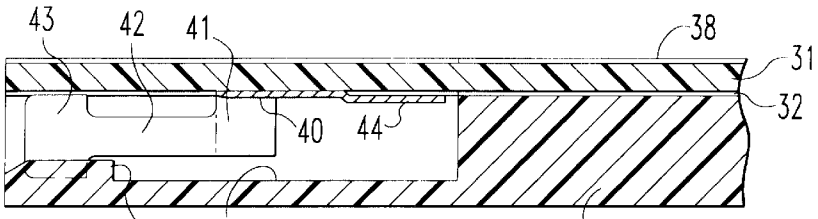
Figure 8:
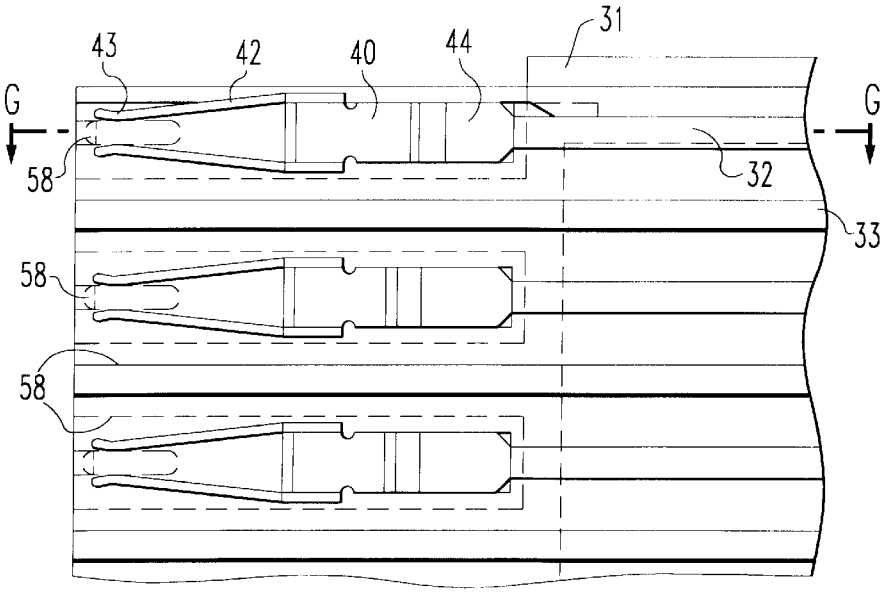

FIGS. 8 and 8*a* illustrate enlarged views of the connector contacts 34 located in recesses 57 of the cover 56. FIG. 8*a* is a cross sectional view taken along line GG of FIG. 8 and shows the positioning of the pre-load rib 58 with respect to the contact portions 43.

Figure 9:
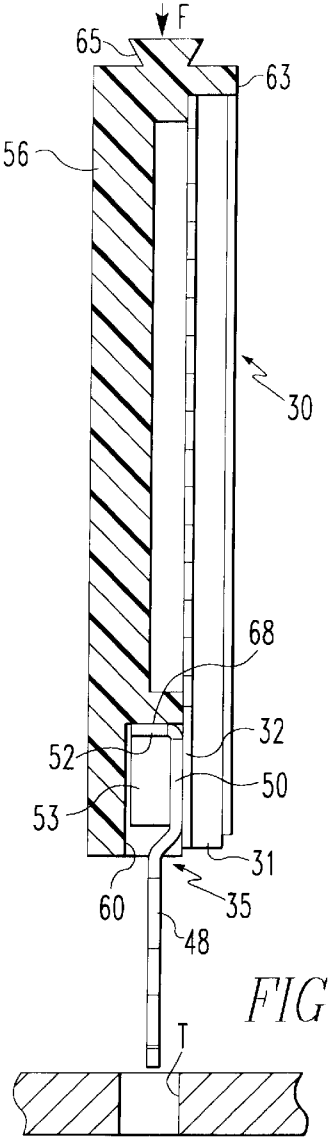
FIGS. 8–8*a* and 9 are enlarged views showing portions of the integrated terminal column module shown in FIG. 7.

FIG. 9 illustrates the interaction of the cover 56 with the board connection terminal 35 when a downward force F is applied to the top edge of the module 69. That force is transmitted by the cover to the pressing surface 68 formed by the top surface of the recess 60. As a result, a vertical insertion force that is used to push the press-fit 48 section into the hole T is applied directly to the upper tang 52 and the side tangs 53. In this manner, shear stress occurring at the solder connection between the base 50 of the terminal and the circuit trace 32 is minimized. In this manner, loosening or detachment of the terminal 35 is avoided. This is achieved, at least in part, by positioning the surface 68 so that it will engage tang 52 before the rim 63 begins applying a vertical force to the upper edge of the substrate 31. One way to accomplish this is to provide an initial, small clearance between the rim 63 and the adjacent edge of substrate 31. Additionally, the cover is designed so that a significant proportion of the insertion force is applied directly to terminal 35 so that stress at the terminal/conductive track interface is minimized. The structure disclosed is designed to withstand required press-fit pin insertion forces of 35–50 Newtons per pin.

Figure 10B:
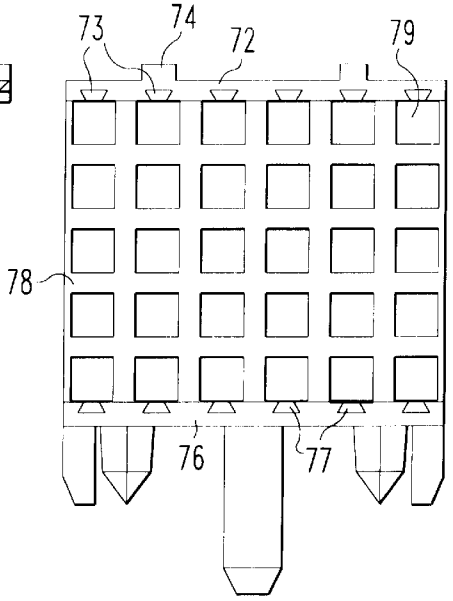
FIGS. 10–10*c* shown views of a connector housing for receiving a plurality of modules as illustrated in FIG. 7.
Figure 10:
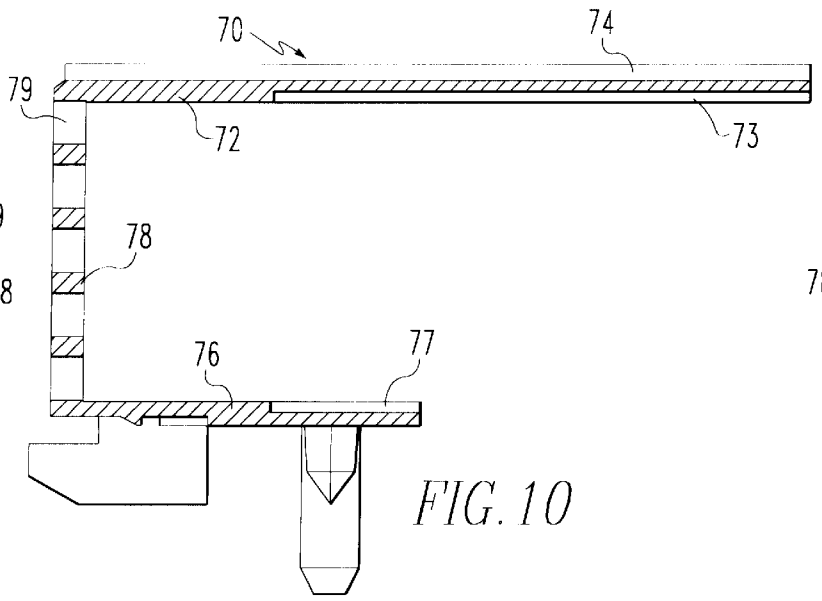
Figure 10A:
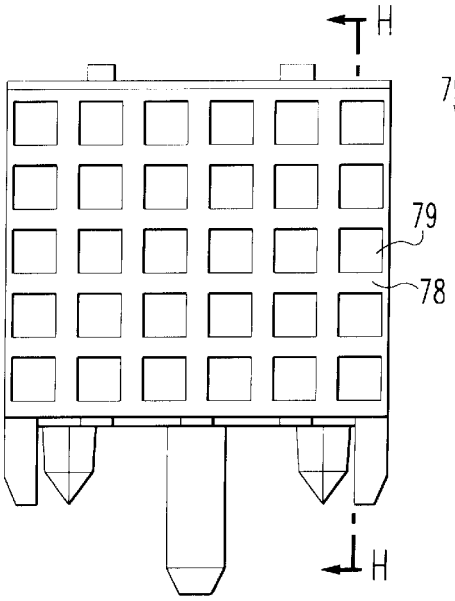
Figure 10C:
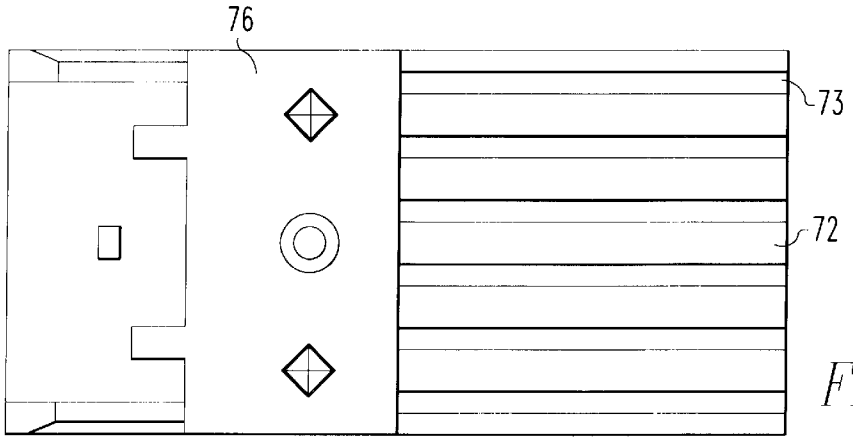

FIG. 10 is a cross sectional view taken along line HH of FIG. 10*a* and shows a connector housing 70 having a top wall 72, a bottom wall 76 and a front wall 78. The top wall 72 includes a plurality of locating slots, for example the dove tail slots 73. One or more guiding ridges 74 may be formed on a top surface of the top 72. The bottom 76 also includes locating slots, for example the dove tail slots 77. The front wall 78 includes a plurality of openings 79. Additional shielding can be provided by metallizing appropriate surfaces of the housing 70. FIG. 10*c* shows a bottom view of the housing 70 shown in FIG. 10.

Figure 11:
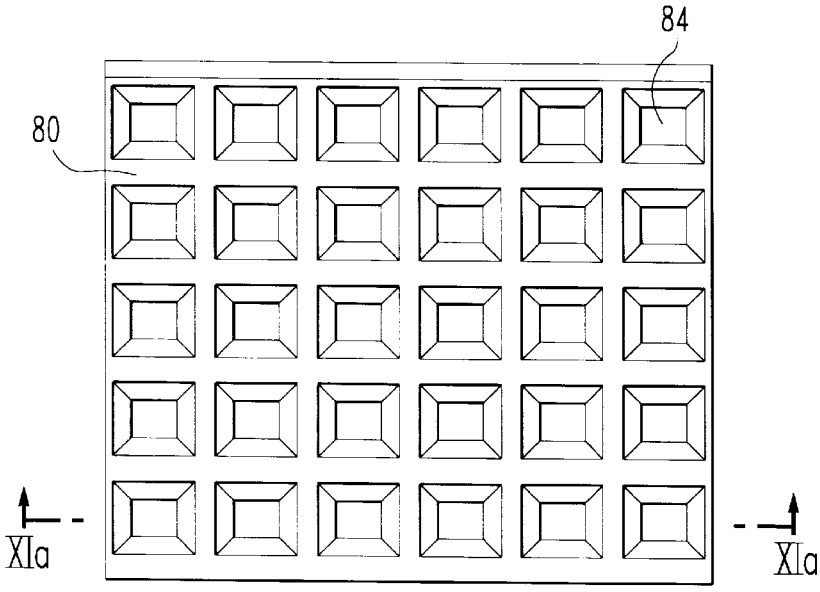
FIGS. 11–11*a* and 11*b* show various views of a lead-in plate for the housing shown in FIG. 10.
Figure 11A:
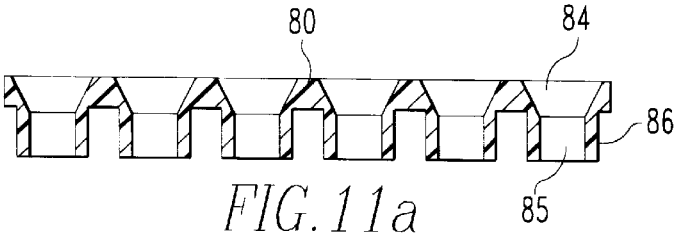
Figure 11B:
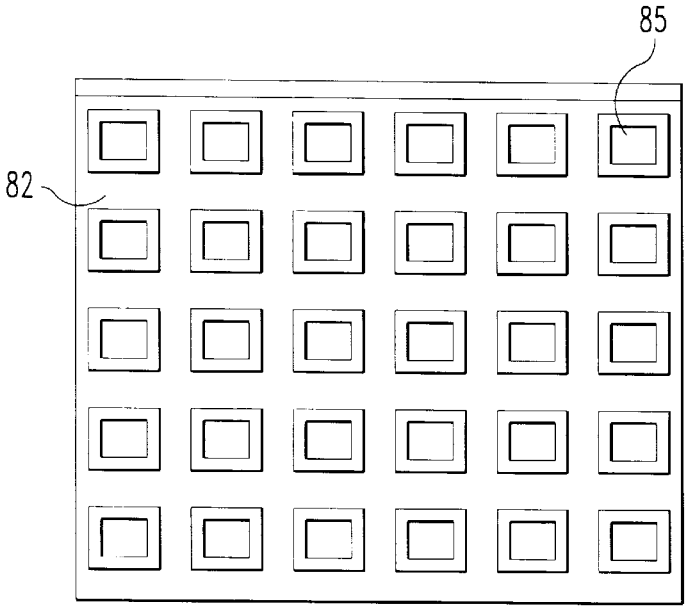

FIG. 11 is a front elevational view of a lead-in face plate 80 having a plurality of tapered lead-in sections 84 arranged in the form of a grid. Each of the lead-in portions 84 extends to a pin insertion port 85. A plurality of sleeves or hollow bosses 86 extend from the rear surface of the face plate 80 and are shaped and sized to be positioned and retained in the openings 79 in the front wall 78 of housing 70. The use of a separate lead-in plate is desirable when the interior surfaces of the housing 70 are to be fully metallized. However, the housing 70 can also be formed with the lead-in plate integrally molded, where selective metallization or no metallization is utilized.

Figure 12:
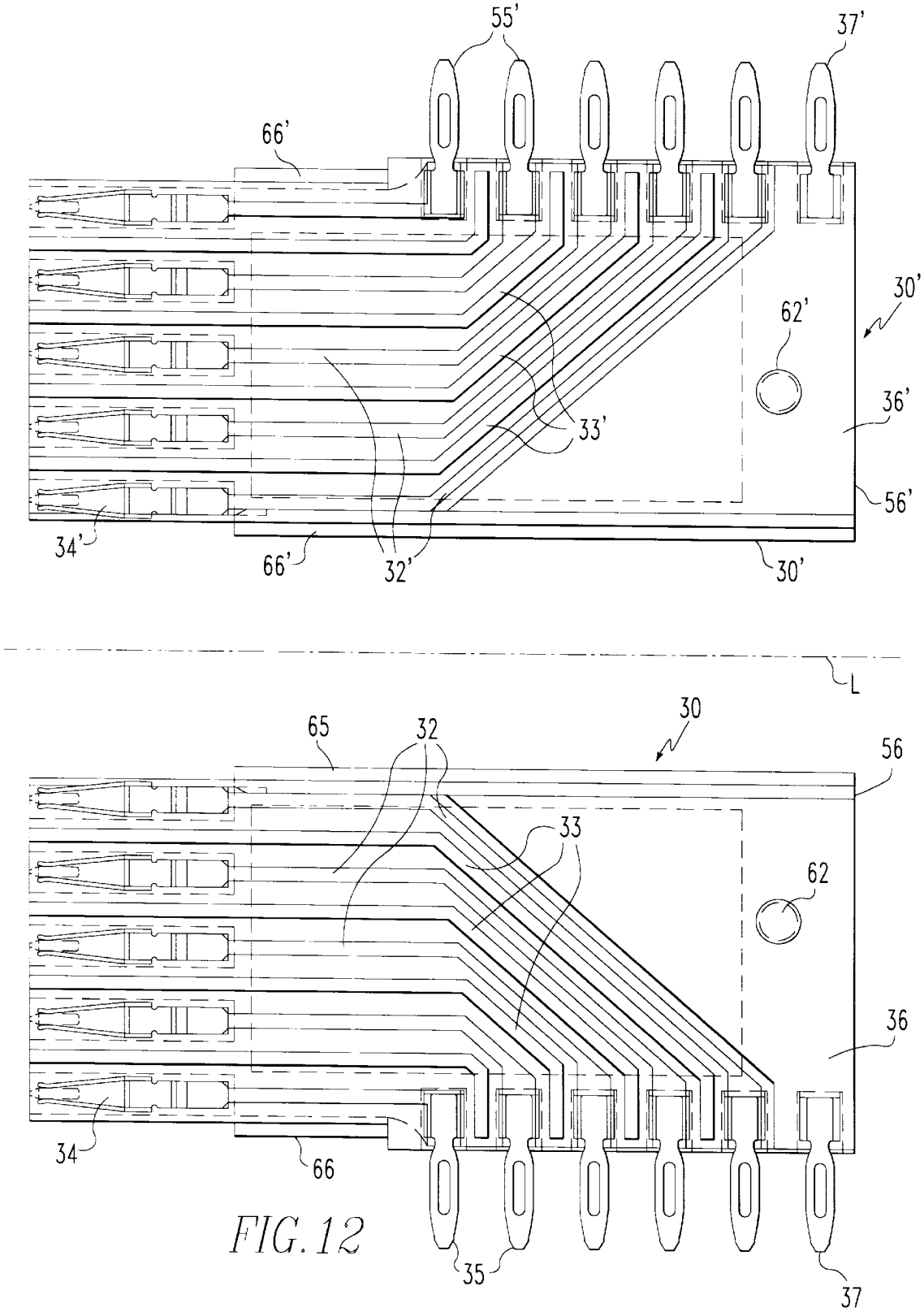
FIG. 12 illustrates two PCB assemblies having a mirror-image relationship.

FIG. 12 illustrates printed circuit board modules configured to provide connectors having shield pairs of terminals. The module 30 shown in the lower portion of FIG. 12 is essentially the same as the module illustrated in FIG. 7 wherein the dotted lines illustrate the location of structures on the side of cover 56 located on the reverse side of the cover adjacent PCB 31 (FIG. 7C). For purposes of clarity, traces 32 and 33 have been shown in full line rather than dotted or phantom form. The elements forming the module 30 are the same as those discussed in connection with FIGS. 2–9 and no further description thereof is believed necessary. PCB module 30' includes essentially the same elements as module 30 and these have been designated by the designation. Module 30' differs from module 30 essentially in the aspect that the elements of this module are arranged to constitute a mirror-image with a respect to line L.

Figure 13:
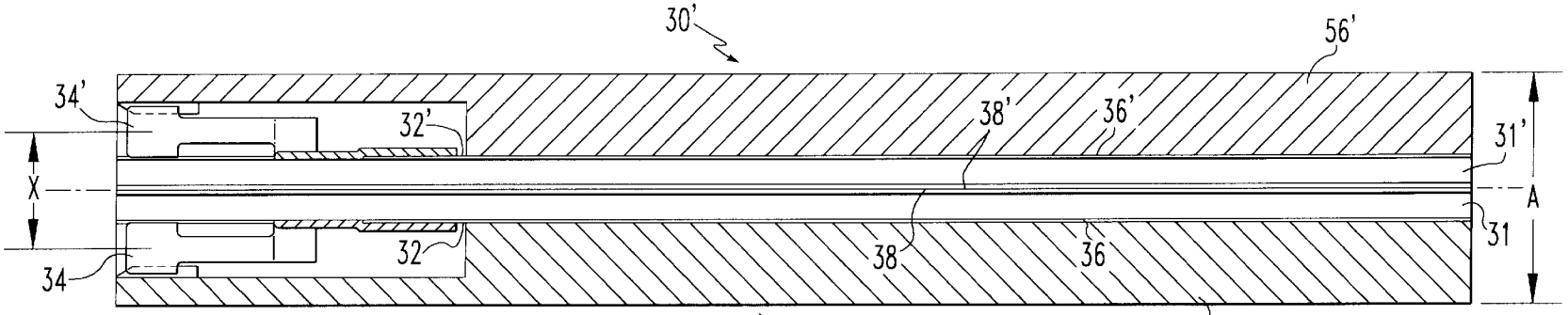
FIG. 13 is a generalized cross-section of two PCB assemblies positioned in back-to-back relationship to form matched pair or twinax conductor paths.
Figure 14:
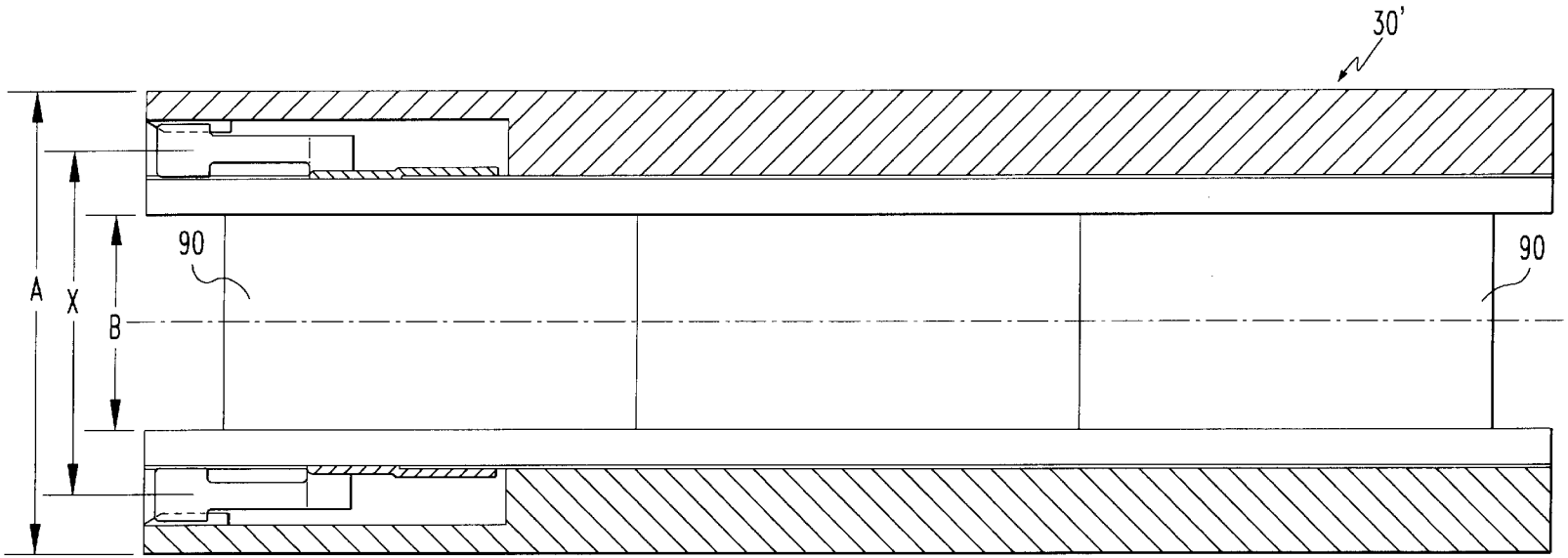
FIG. 14 shows a shielded pair module with spaced PCB assemblies.

FIG. 13 illustrates a generalized cross-sectional view of modules 30 and 30' arranged in back to back relationship to form a complete shielded pair module that can be placed in side by side relationship with similar modules to form a connector. In this arrangement, the back shielding layers 38, 38' of the PCB's 31, 31' are arranged adjacent one another to form the shielded pair module. The modules 30, 30' can be held in the illustrated relationship by insertion into housing 70 (FIG. 10) or, if desired, by a conductive adhesive layer applied to adjacent outer surfaces of shielding layers 38, 38'. In the shielded pair modules shown in FIG. 13, the dimension X represents the centerline distance between the terminals 34 and 34', which essentially constitutes the contact pitch between the terminals. The dimension A represents the overall thickness of the shielded pair module. As illustrated, the dimension A is twice the thickness of one of the PCB modules 30, 30. Preferably, the dimension A is chosen so that the terminal pitch X is maintained between adjacent shielded pair modules. Referring to FIG. 14, spacers 90 having a thickness represented by the dimension B may be placed between PCB modules 30 and 30' to achieve a desired terminal pitch X.

Figure 15:
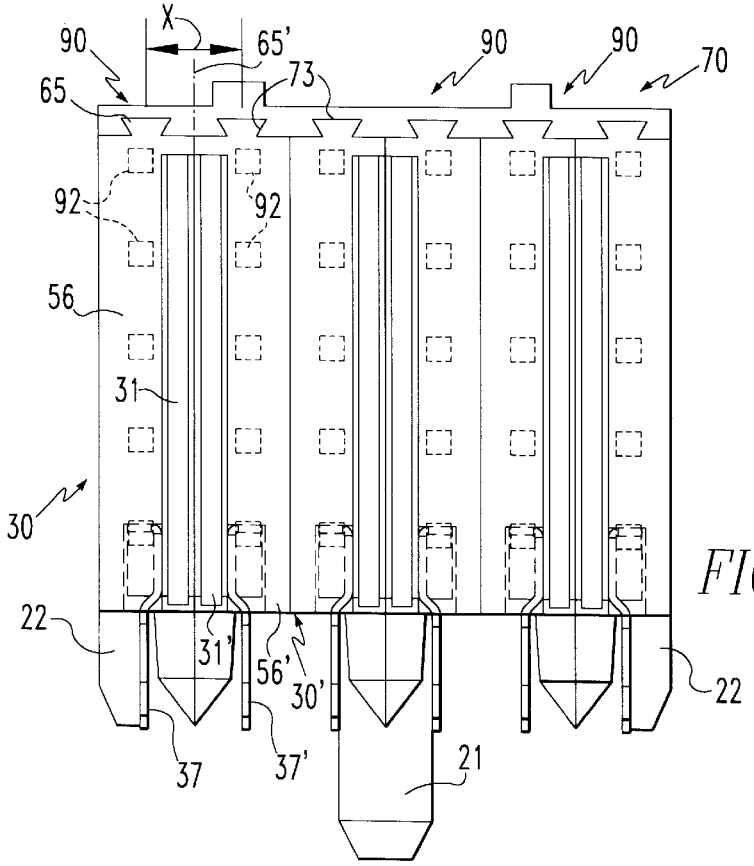
FIG. 15 is a rear view of an assembled connector having a plurality of shielded pair PCB assemblies.

FIG. 15 is a rear view of a completed 5×6 connector (rows×columns) formed by juxtaposing three shielded pair modules arranged in side by side relationship within housing 70. Each module 90 includes a pair of juxtaposed PCB's 31, 31' on which press-fit terminals (such as shield terminals) 37, 37', are mounted. Each PCB 31, 31' is held by an associated insulative cover 56, 56'. The covers 56, 56' have dove-tail ribs 65, 65' fitted within dove-tail slots 73 in the housing. The dotted squares 92 represent the locations of the terminals 34, 34' and generally correspond to the location of the openings 85 in the face-plate 80 (FIG. 11). The contact pitch X existing between adjacent columns at the intermating face of the connector also exists at the board mounting interface at terminals 37. Each of these shielded pair modules 90 carry five shielded pairs of terminals and terminal leads in the 5×6 configuration illustrated in FIG. 15.

Figure 16:
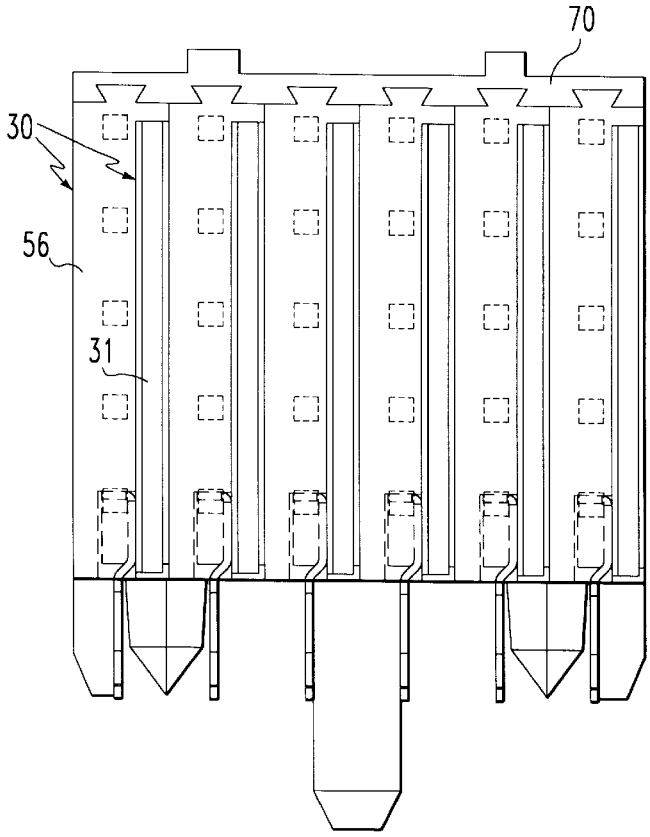
FIG. 16 is a rear view of an assembled connector having individually shielded signal traces.
Figure 17C:
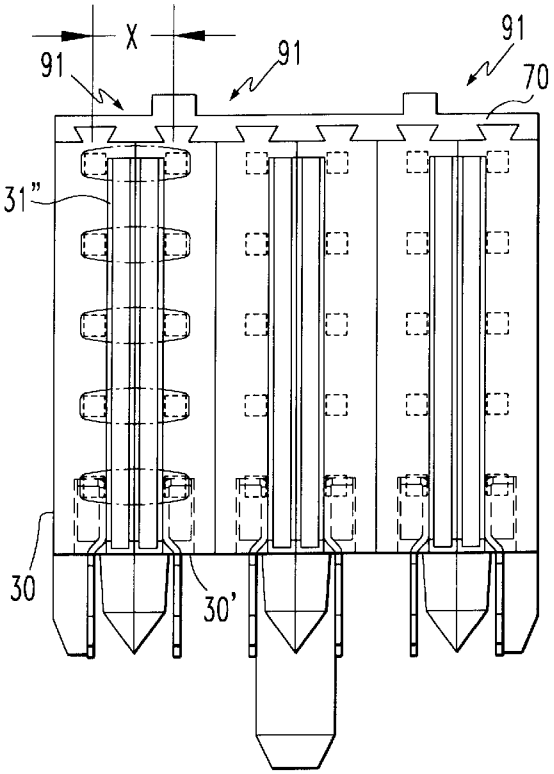
FIGS. 17*a*, 17*b* and 17*c* show several PCB arrangements for forming shielded connectors.
Figure 17B:
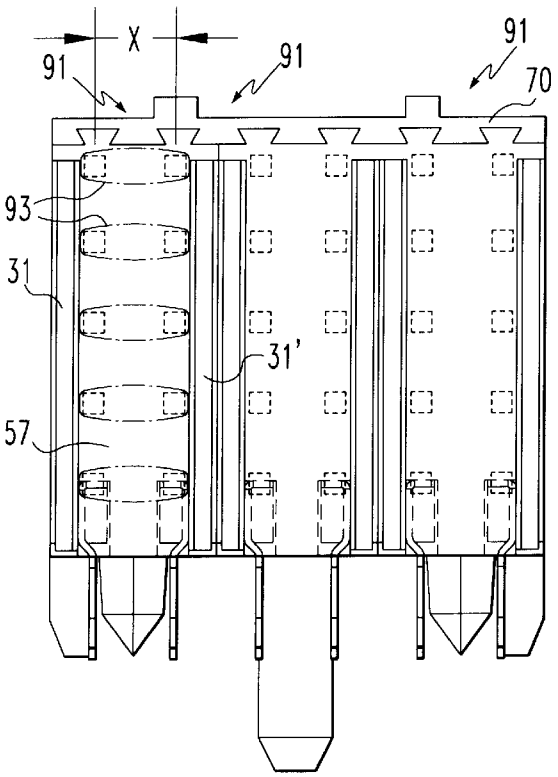
Figure 17A:
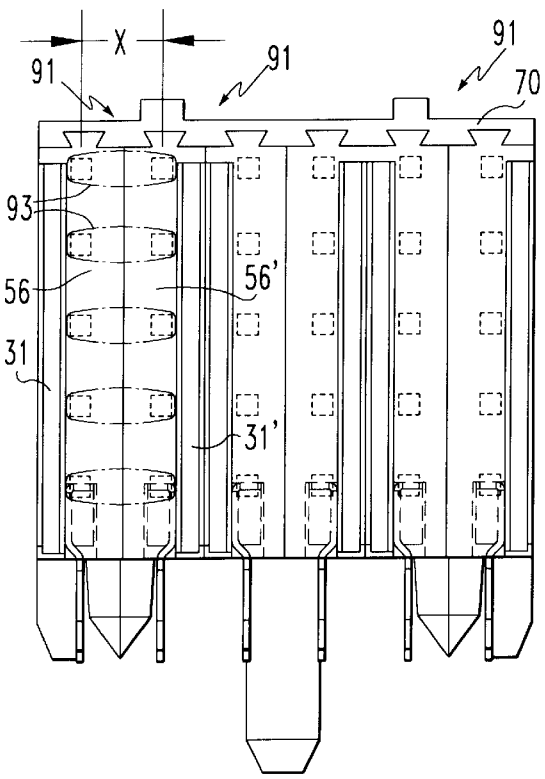

FIG. 16 is a rear view of a connector essentially as illustrated in prior co-pending International Application Ser. No. PCT/US96/11214 filed Jul. 2, 1996. In this arrangement, the PCB modules 30 are arranged in the connector housing 70 so that all of the PCB assemblies 30 are oriented in the same way, for example, with the cover 56 disposed on the left-hand side and the PCB 31 disposed on the right-hand side. This results in a connector having each terminal being substantially fully electrically isolated from all others in the connector. For comparison, FIGS. 17*a*, 17*b*, and 17*c* illustrate connectors embodying an aspect of the present invention. FIG. 17*a* illustrates from a rear view one form of twinax connector having shielded pairs of terminals and terminal leads. This arrangement differs essentially from that shown in FIG. 15 by having the relative positions of the covers 56, 56' and PCB's 31, 31' reversed. In this connector, the terminal pair modules 91 are formed by placing the covers 56, 56 in back to back relationship with the PCB's 31, 31' forming the exterior surfaces of the module. In this arrangement, the signal and ground traces 32, 32' and 33, 33', respectively are located in facing mirror-image relationship on the interior surfaces of the PCB's 31, 31', with the outer-shielding layers 38, 38' disposed outwardly. Such an arrangement forms twinax pairs 93 of terminals that are substantially parallel through the conductor and have essentially identical electrical characteristics. These pairs are shown by the dotted enclosures 93 for the left-hand most module 91. The connector shown in FIG. 17*b* is essentially the same arrangement as that shown in FIG. 17*a*, with the exception that instead of two covers 56, 56', a single insulative member 57 is utilized to hold the opposed PCB's 31, 31'. In each of the modules 91 the outer surfaces of the member 57 are configured similarly to the interior surfaces of the covers 56, 56'. FIG. 17*c* essentially illustrates the arrangement previously discussed with respect to FIG. 15. Instead of using two PCB's, a single multi-layer PCB 31" may be employed having a centrally located, substantially continuous central shield layer, with the signal and shielding traces formed on opposed sides of the 31" in mirror-image relationship.

Figure 18A:
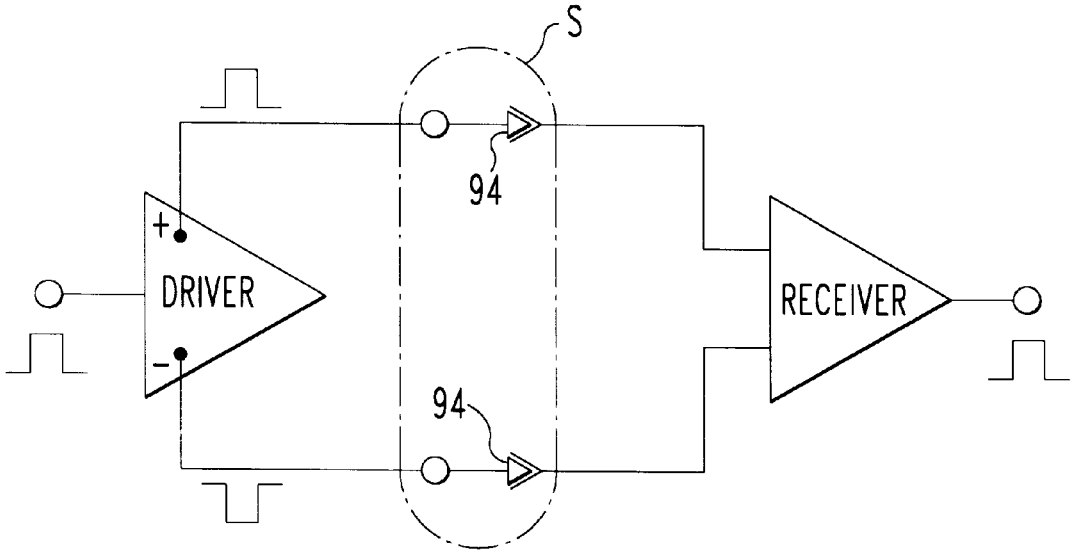
FIGS. 18*a* and 18*b* are schematic circuit diagrams of the arrangements shown in FIGS. 17*a*–17*b* and FIG. 17*c*, respectively.
Figure 18B:
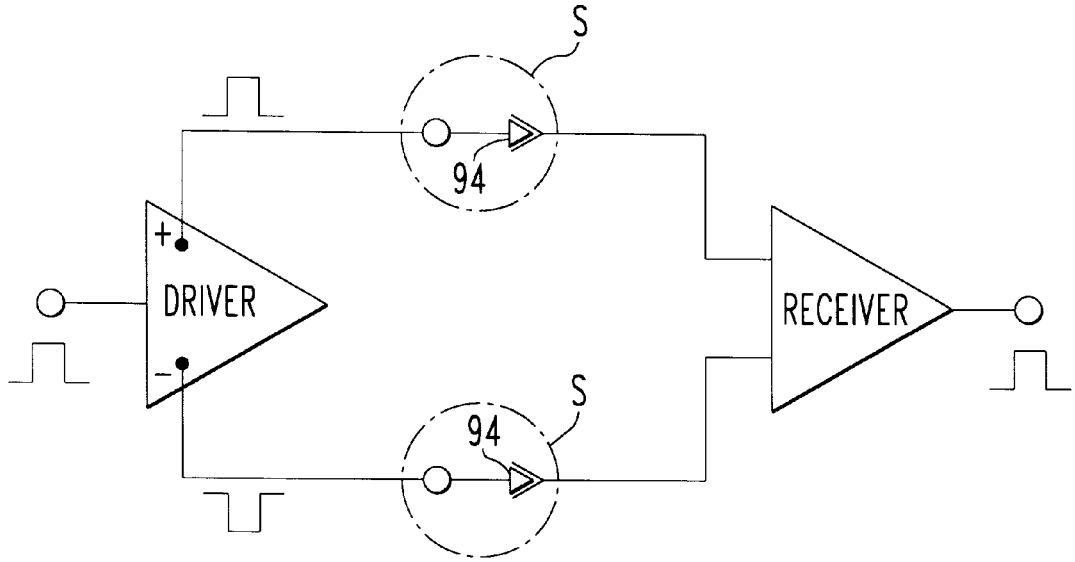

FIGS. 18*a* and 18*b* are schematic representations designed to illustrate the electrical differences between the FIGS. 17*a–b* type of connectors and the FIG. 17*c* type of connector. Referring to FIG. 18*a*, the pair of interconnection terminals 94 are electrically isolated by a common shield S. Whereas, in FIG. 18*b* each of the interconnections 94 of the pair are individually shielded. In either case, an electrically matched pair of interconnections are formed to maintain essentially a twinax relationship through the interconnection.

Figure 19B:
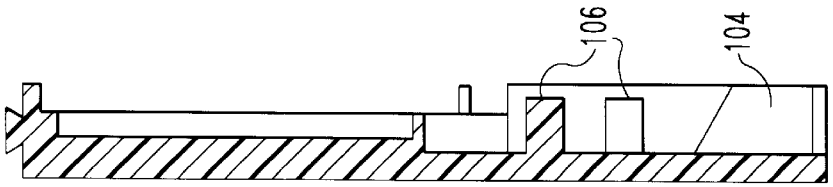
FIGS. 19, 19*a* and 19*b* show a cover for use with cable connectors.
Figure 19A:
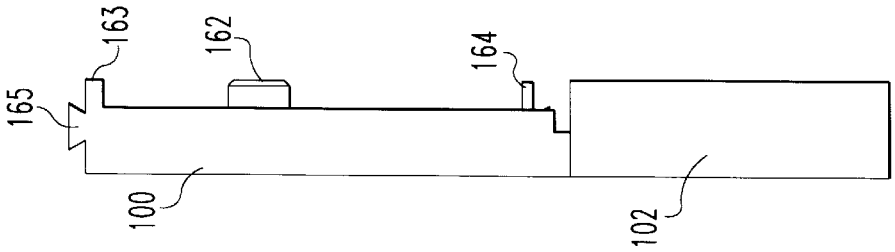
Figure 19:
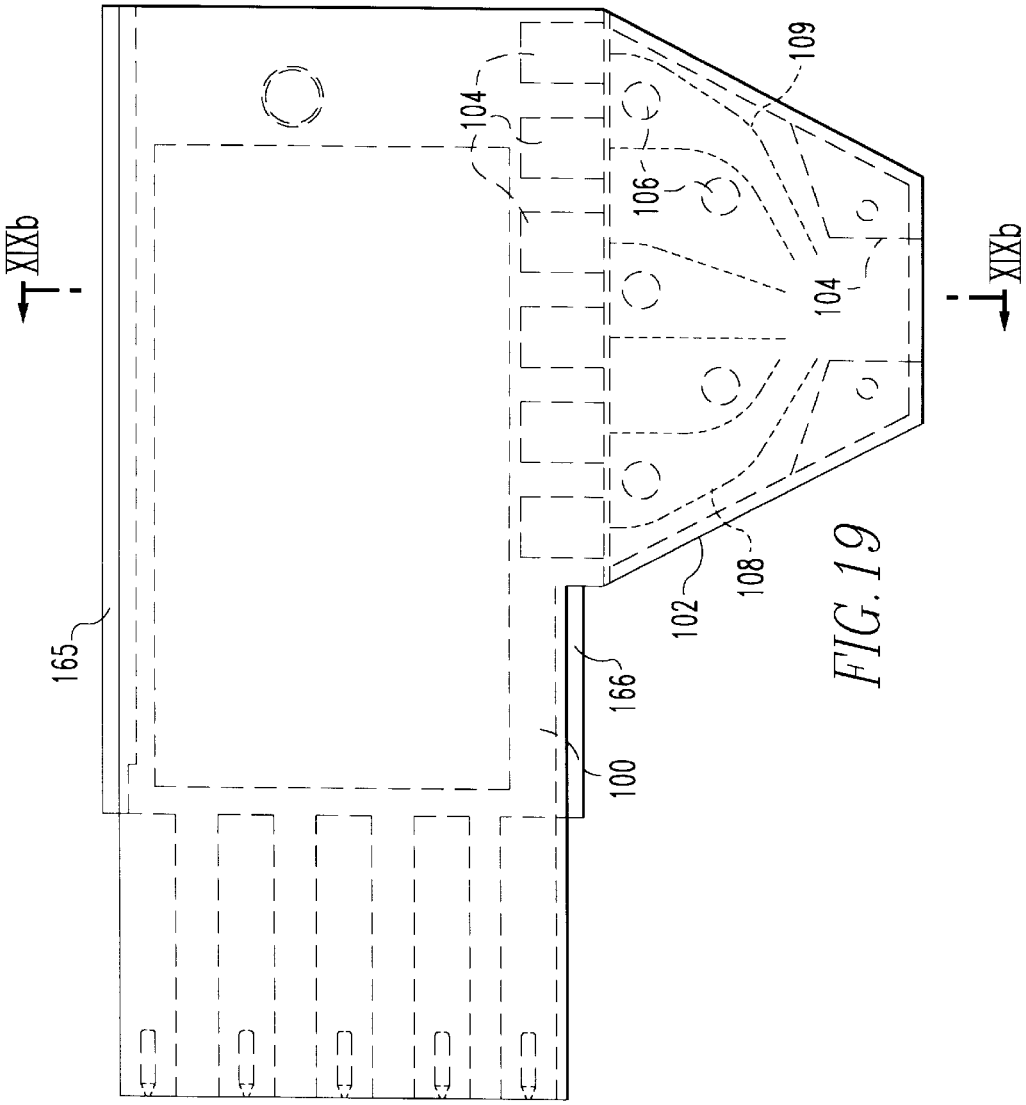

The foregoing descriptions have been in the context of connectors that are attached to printed circuit boards. FIG. 19 illustrates an arrangement for cable connectors. FIG. 19 shows a cover 100 for use with a circuit board generally of the type previously described. The upper portion of the cover 100 is substantially similar to the cover 56 shown in the previous embodiments. It includes on its upper and lower surfaces dove-tail ribs 165 and 166 that are designed to be received in corresponding dove-tail grooves in a housing, such as housing 70 shown in FIG. 10. A printed circuit board has a plated through hole for receiving the locating lug 162. The locating ribs 163 and 164 are the equivalent of locating ribs 63 and 64 shown in FIG. 6C and serve to locate the PCB in the same manner. The PCB assembly to be associated with the cover 100 differs from those previously described essentially by the absence of press-fit terminals 35 and 37.

The cover 100 includes a retaining structure 102 for retaining a flexible conductor, for example, a cable formed of a plurality of individual wires. The retaining structure 102 includes an opening 104 for receiving the cable. A suitable strain relief element or elements may be provided at the location of opening 104 to enhance cable retention. The retaining structure 102 preferably includes a plurality of routing pegs 106 that are useful to separate individual wires that are to be attached to the PCB. Such individual wires are schematically illustrated by the dotted lines 108 in FIG. 19. The ends of the wires 108, 109 may be soldered to contact pads on the PCB that are coincident with the recesses 110 in the cover 100. Subsequent to soldering the wires 108, 109 to the PCB, the PCB is assembled to the cover 100 and the individual wires 108 are arranged between the pegs 106. If the cable (not shown) includes one or more drain lines, which can be represented by the line 109, these drain lines can be soldered to the shielding structures of the printed circuit board such as traces 33, layer 36 and 38 by connection at an appropriate location, for example, the right hand at most location of the PCB that in the previous embodiment corresponds to the location of press-fit shield terminal 37. For twinax cable connectors, shielded pair modules employ two covers 100, one of which is a mirror-image of the other. Each one of a twisted wire pair is connected to corresponding traces on each of the printed circuit boards.

If each twisted pair has an individual drain, the drain wire can be connected to an appropriate shielding trace 33.

Figure 20A:
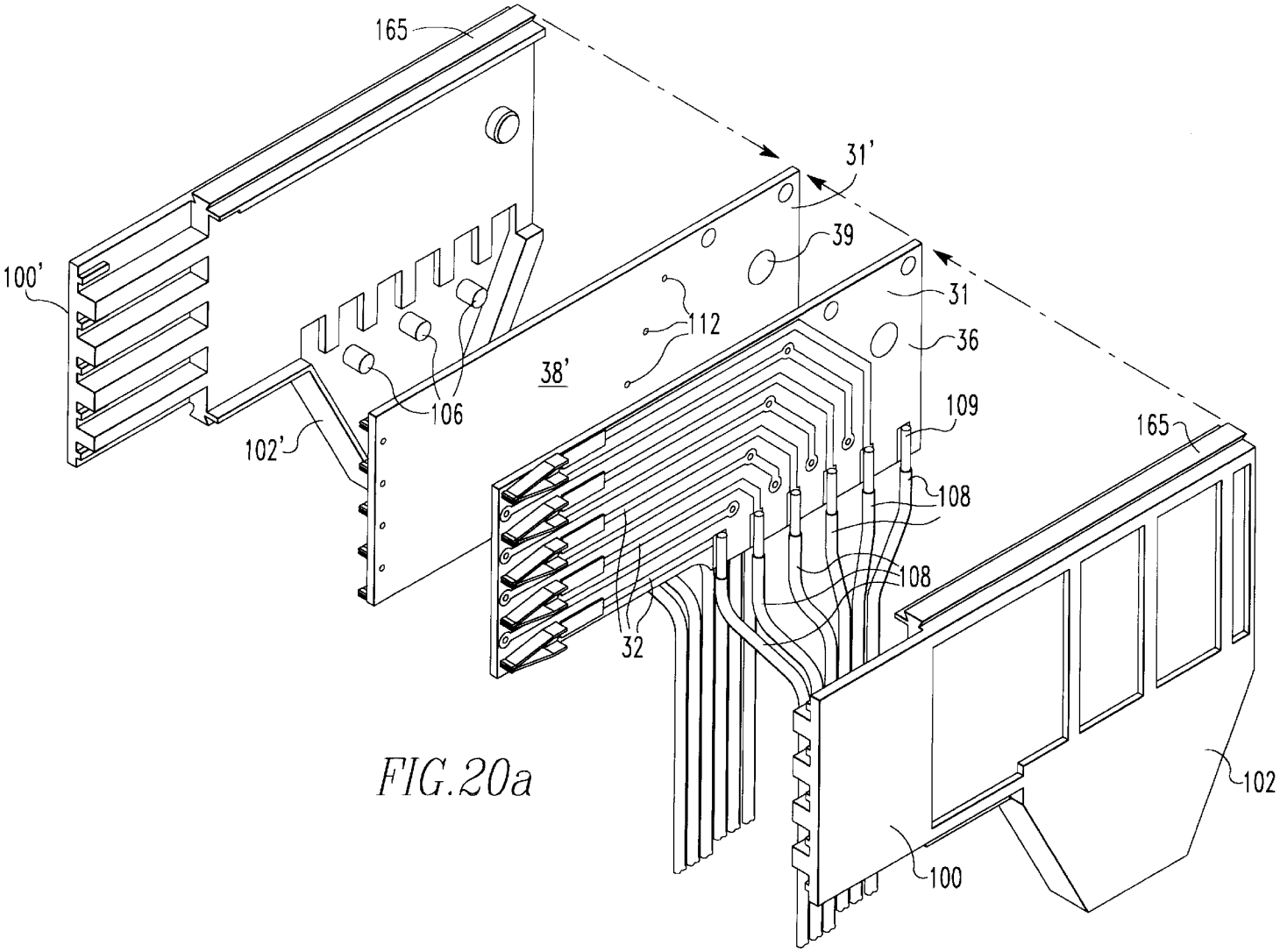
FIG. 20*a* is an exploded isometric view of a twinax cable connector module.
Figure 20B:
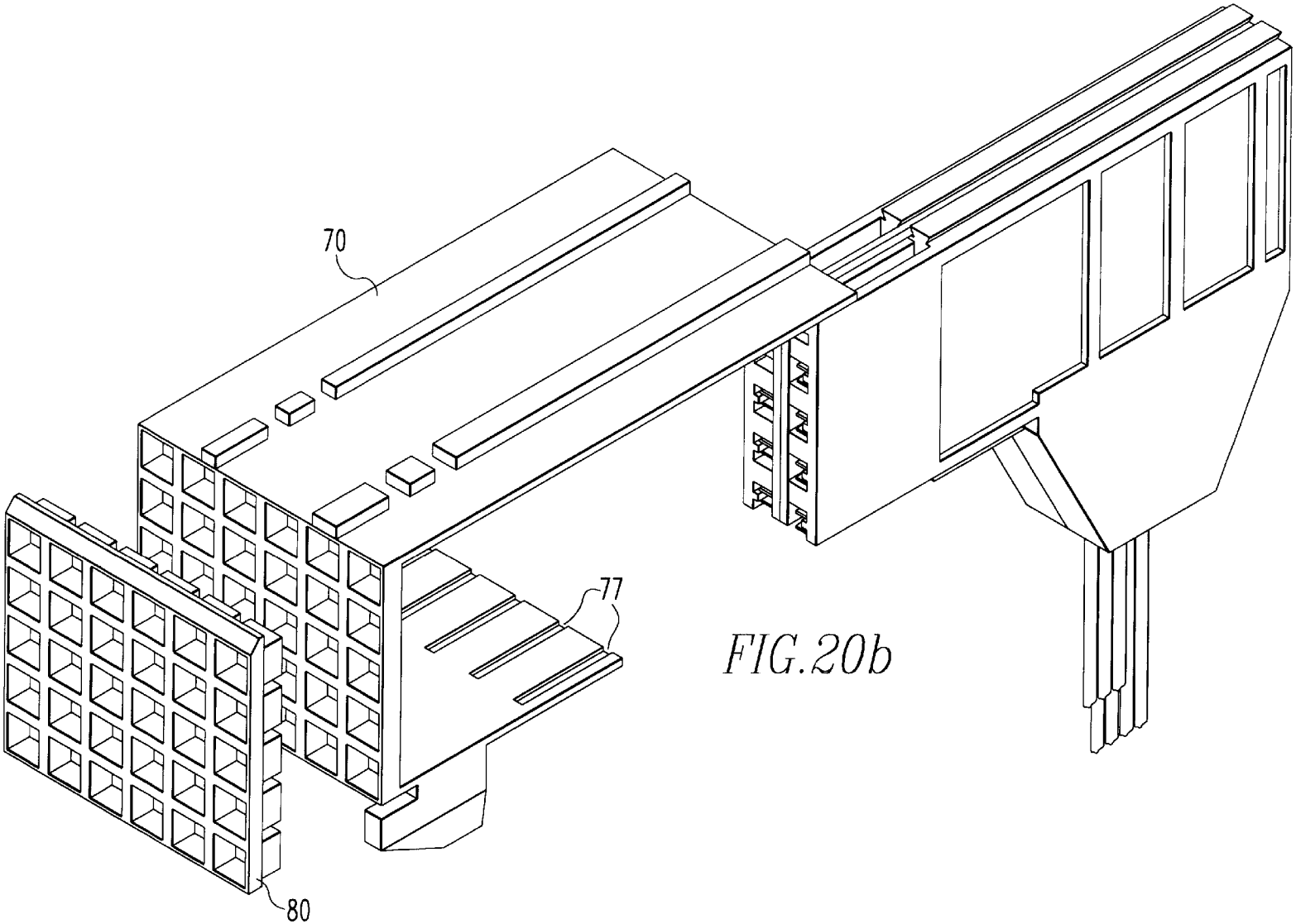
FIG. 20*b* is an isometric view of the module of FIG. 20*a* in assembled form and positioned for insertion into a connector housing.
Figure 20C:
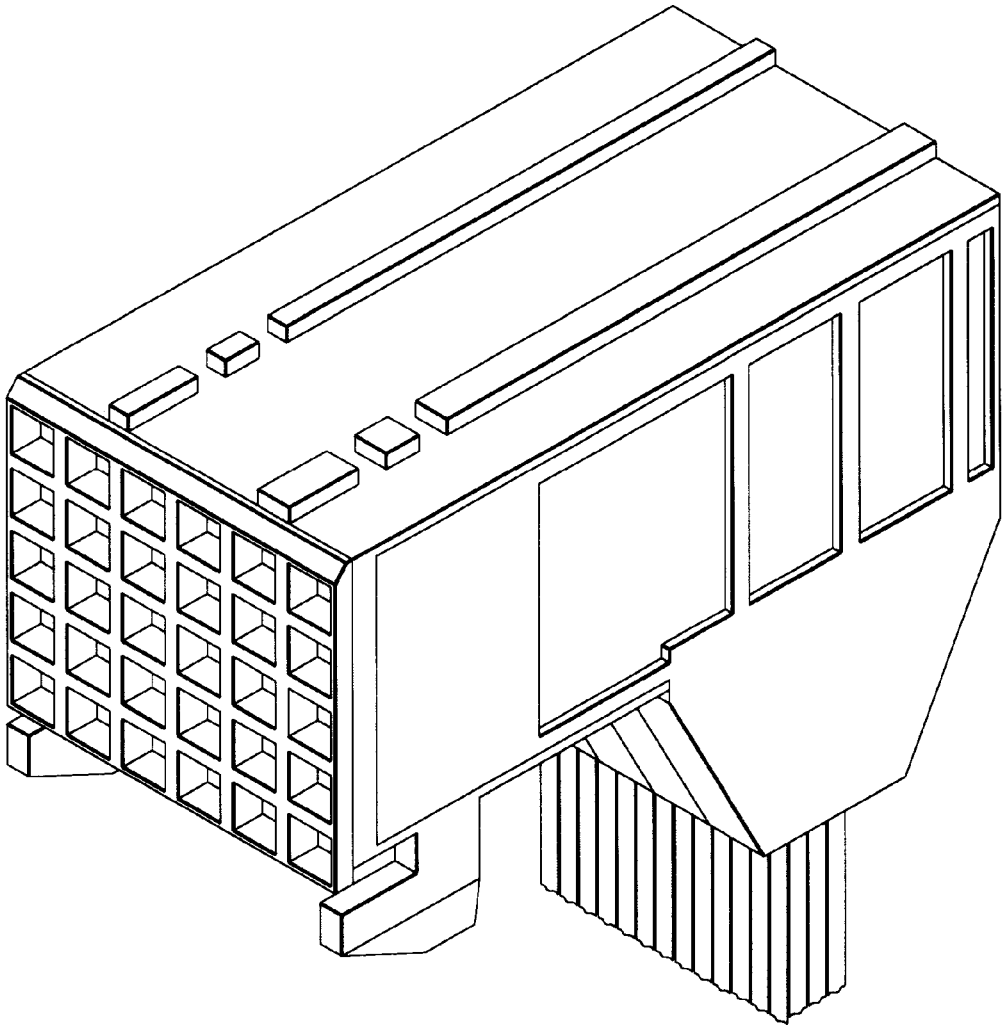
FIG. 20*c* is an isometric view of a completed right angle cable connector.

FIGS. 20*a*–20*c* illustrate the components of a typical cable connector. The connector illustrated is a twinax connector but other configurations are possible by varying the relative orientation and layout of the modules. In this connector there are two mirror image PCB's 31 and 31' placed in back to back relationship with shielding layers placed next to each other. Signal wires 108 are each attached to one of the conductive signal traces 32 on each of the PCB's 31 and 31', along a bottom edge of each PCB. In a twinax connector, conductors from each twisted pair would be attached to corresponding signal traces on each of the PCB's 31 and 31'. If a drain or shield 109 is present in the cable, it can be secured to the shield portion 36 . The securing of the various wires to the PCB's is accomplished by conventional means, such as soldering or welding.

The shield traces 33 and shield portion 36 are interconnected to the shield layers 38 and 38' by plated vias 112 and the plated location hole 39 as previously described. Covers 100 and 100' are secured onto the respective PCB's 31 and 31'. The retainer sections of each cover surround the ends of the wires attached to the PCB's 31 and 31'. The retaining sections include the pegs 106, which provide strain relief and wire support functions.

The PCB's 31 and 31' may be held together by a conductive adhesive or may be closely held together by the effect of the dove tail ribs 165 and 165' and corresponding dove tail slots 73 and 77 in the housing 70, as the module is assembled in the housing 70 as shown in FIG. 20*b*. A plurality of modules are arranged in the molded plastic housing 70, the interior surfaces of which may be metallized to provide additional shielding. The face plate 80 is secured to housing 70 to form the completed right angle cable connector shown in FIG. 20*c*.

Figure 21A:
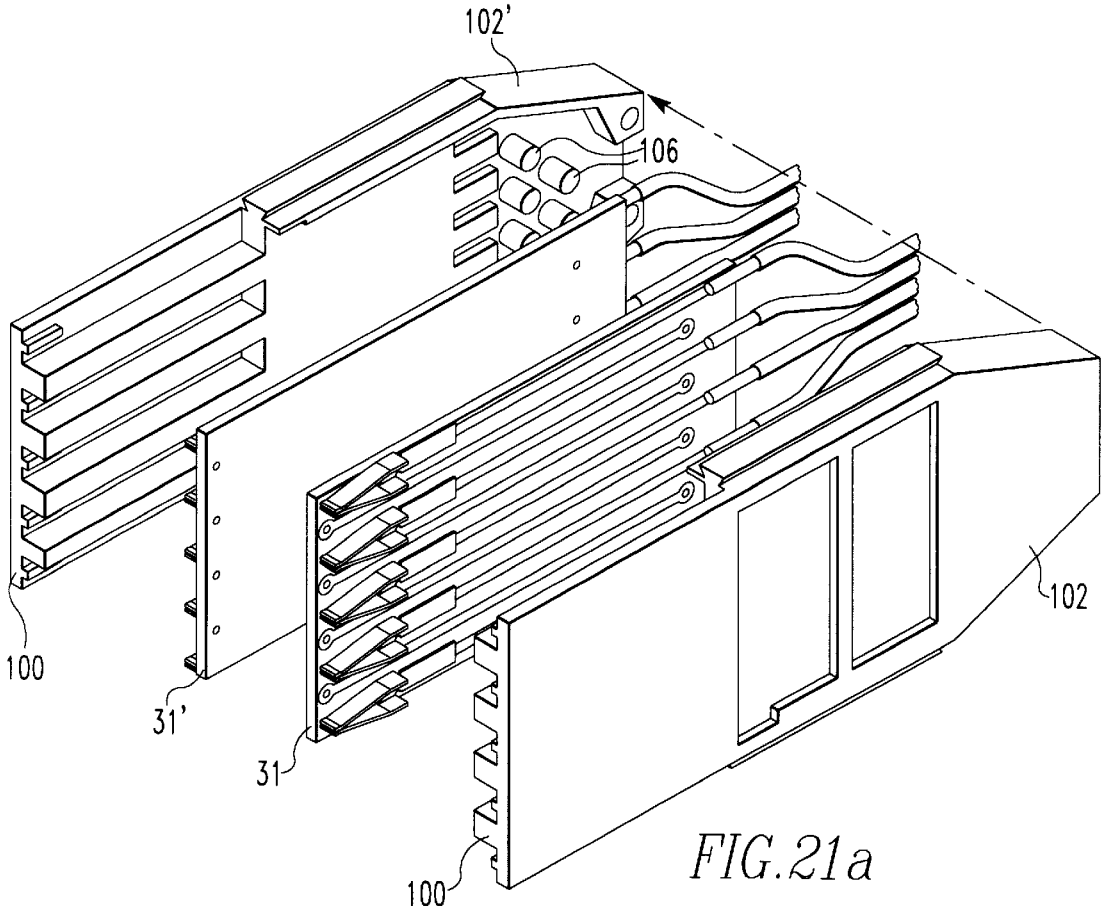
FIG. 21*a* is an exploded isometric view of a twinax straight cable connector module.
Figure 21B:
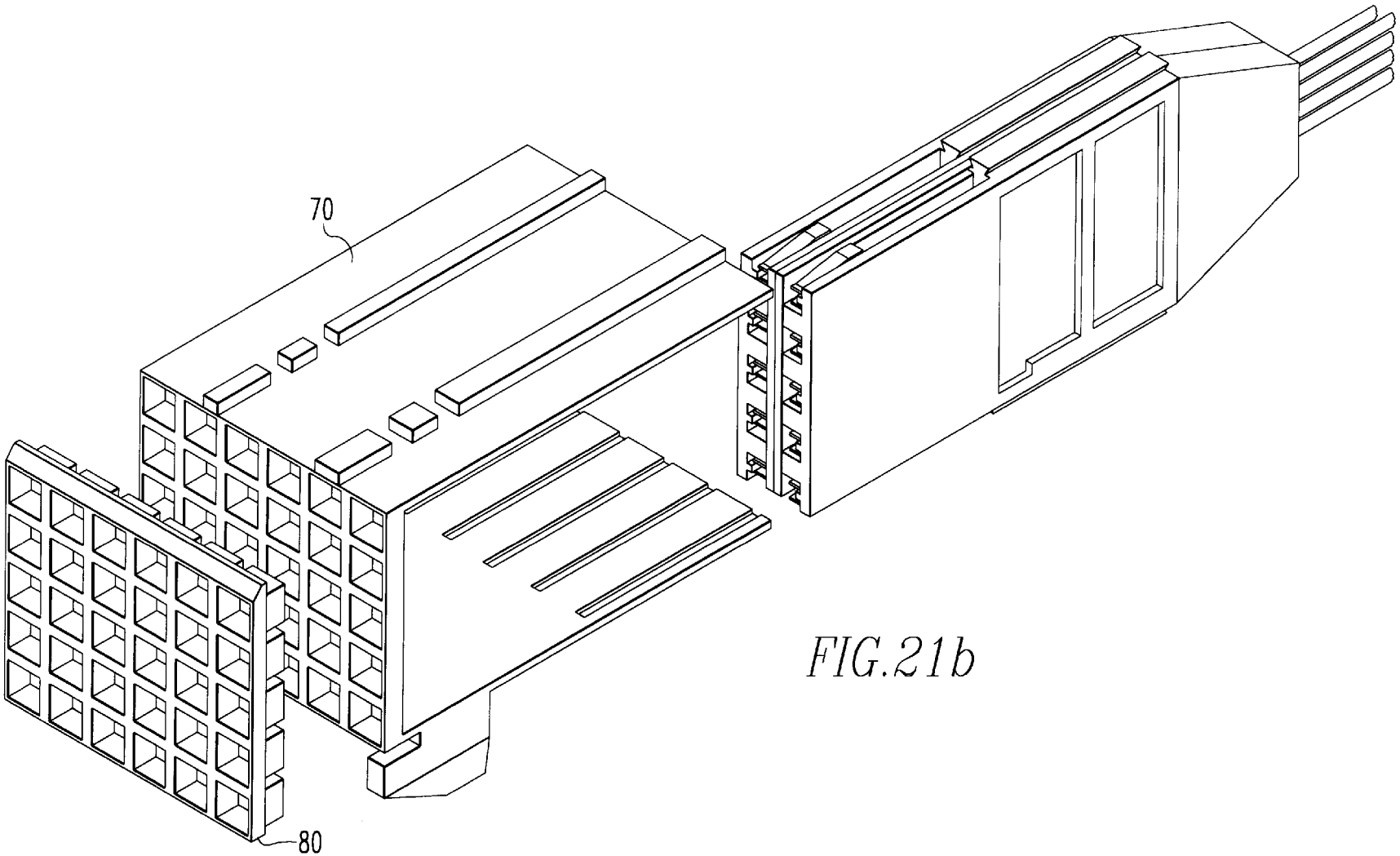
FIG. 21*b* is an isometric view of the module of FIG. 21*a* in assembled form and positioned for insertion into a connector housing.
Figure 21C:
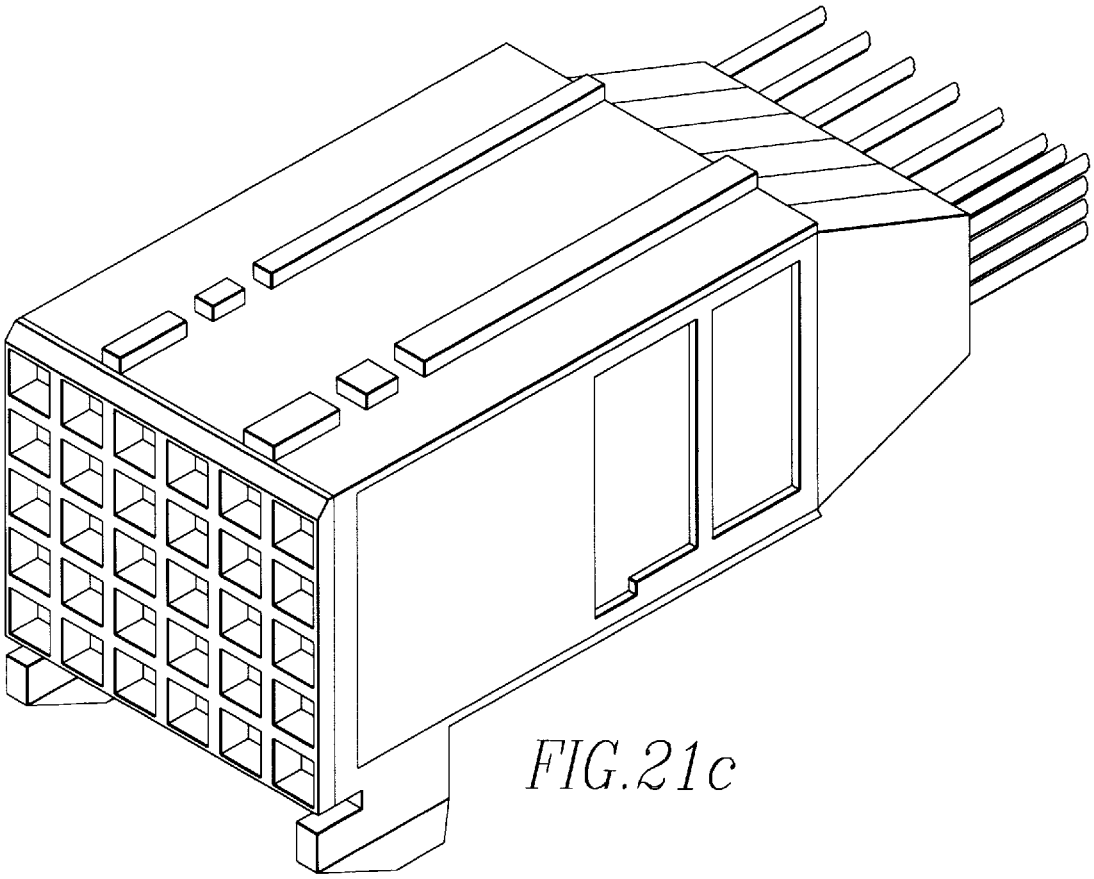
FIG. 21*c* is an isometric view of a completed straight cable connector.

FIGS. 21*a*–21*c* show essentially the same elements illustrated in FIGS. 20*a*–20*c* with the exception that the PCB's 33 and 33' are configured to provide a cable connection end at the rear edge of the PCB's rather than the bottom edge. The insulating covers 100 and 100' are modified correspondingly to situate the cable retaining sections 102 and 102' at the rear edges of the PCB's. The covers include pegs 106 for providing support, organization, and strain relief. The covers 100 and 100' may be secured together at engaging edges along the PCB's and at the retaining sections, for example by adhesives or solvent or heat welding.

The modules are then inserted into housing 70 as shown in FIG. 21*b* and are retained in the housing as previously described. A completed straight connector is formed by the insertion of a plurality of modules in side by side relationship into the housing 70 and securing a face plate 80 on the housing, as illustrated in FIG. 21*c*.

The foregoing constructions yield connectors with excellent high speed characteristics at relatively low manufacturing costs.

While the present invention has been described in connection with the preferred embodiments illustrated in the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

a housing; and a circuit module mountable in the housing, comprising:

a pair of substantially parallel signal conductors disposed within the module, each extending from a first region of the module to a second region of the module along respective outer surfaces of the module, and having a contact pad at said second region for receiving a conductive element extending along said respective outer surfaces of said module; and at least two electrical contact terminals, each terminal being electrically connected to one of the signal conductors in the first region and extending along said respective outer surfaces of said module, said signal conductors being arranged substantially symmetrically about a longitudinal plane of the module, whereby the signal conductors constitute substantial mirror-images of each other about said longitudinal plane.

2. A connector as in claim 1, comprising at least one additional circuit module mounted on the housing, said additional circuit module being substantially similar to the first mentioned circuit module.

3. The electrical connector as recited in claim 1, wherein said first region and said second region are on opposite edges of said circuit module.

4. The electrical connector as recited in claim 1, wherein the connector is a right angle connector.

5. The electrical connector as recited in claim 1, wherein the connector is part of a cable assembly.

6. An electrical connector as in claim 1, wherein the module further comprises a pair of support members arranged in side by side relationship, each of the support members carrying one of the circuit substrates.

7. An electrical connector as in claim 1, wherein the module comprises a pair of spaced apart circuit substrates, each substrate having an outer surface facing said outer surface of the other said substrate, with each said signal conductor comprising a circuit trace disposed on one of the outer surfaces.

8. An electrical connector as in claim 7, wherein the module further comprises a common support member for supporting both of said circuit substrates.

9. An electrical connector as in claim 1, wherein the module comprises a pair of circuit substrates arranged in a side by side relationship, each having an outwardly facing surface and the signal conductors comprise circuit traces, each of the circuit traces being disposed on one of said outwardly facing surfaces.

10. An electrical connector as in claim 9, wherein the module further comprises a pair of support members, each support member being disposed adjacent one of the outwardly facing surfaces.

11. An electrical connector as in claim 1, wherein the circuit module includes at least one circuit substrate and each of the conductors comprise a circuit trace disposed on the at least one circuit substrate.

12. An electrical connector as in claim 11, wherein the traces are printed traces.

13. An electrical connector as in claim 11, wherein the module includes at least two circuit substrates and each of the traces is disposed on one of the circuit substrates.

14. An electrical connector as in claim 13, wherein each of the circuit substrates is substantially planar and parallel to the other.

15. An electrical connector as in claim 11, wherein the circuit traces are disposed on opposite sides of a single circuit substrate.

16. An electrical connector as in claim 1, wherein each signal conductor is flanked substantially over its length by a pair of shielding conductors.

17. An electrical connector as in claim 16, wherein the signal conductors and the shielding conductors comprise circuit traces on a circuit substrate.

18. An electrical conductor as in claim 17, wherein the module further comprises at least one metallic shielding layer disposed between the signal conductor traces.

19. An electrical connector as in claim 17, wherein the module further comprises a pair of opposed shield layers, each shield layer being disposed on one of two opposed exterior surfaces of the module.

20. A module for an electrical connector comprising;

(a) a first circuit substrate having a circuit trace disposed thereon, the circuit trace extending from a first region of the circuit substrate to a second region of the circuit substrate spaced from the first region;

(b) a second circuit substrate having a second circuit trace disposed therein and extending from a first region of the second substrate to a second region thereof spaced from the first region, the second circuit trace being substantially in spaced mirror-image relationship with respect to the first circuit trace, said first and second circuit traces forming a twinax pair of conductors.

21. A module as in claim 20, and further comprising a substantially planar shield structure for electrically shielding the conductive traces.

22. The module as recited in claim 20, wherein said first region of said first and second circuit substrates is perpendicular to said second region of said first and second circuit substrates for use in a right angle connector.

23. The module as recited in claim 20, wherein said first region and said second region are on opposite edges of each of said first circuit substrate and second circuit substrate.

24. A module as in claim 20, wherein the first and second substrates comprise opposite first and second sides of a circuit board.

25. A module as in claim 24, wherein the circuit board further comprises a shield layer disposed between the first and second sides.

26. A module as in claim 20, wherein the first substrate and the second substrate comprise a pair of circuit boards, each board having two primary sides, with one of said circuit traces disposed on one of said primary sides of each circuit board and a shield layer disposed on an opposite primary side of each circuit board.

27. A module as in claim 26, wherein the circuit boards are arranged with the shield layer of each board in back to back relationship.

28. A module as in claim 26, wherein the circuit boards are arranged with the shield layers in opposed relationship.

29. A module as in claim 28, and further comprising a common support member for holding the circuit boards in said substantially opposed relationship.

30. The module of claim 29, wherein the support member includes structure for mounting the module in a housing.

31. An electrical connector comprising:

a plurality of circuit board modules, said modules including shielded pairs of twinax conductive traces, each conductive trace in said pair of conductive traces being located on a different module; ground traces provided on a first surface between each said conductive trace; and a ground trace provided on a second surface wherein said ground traces define a shield around each twinax pair; and a support adapted to receive the plurality of modules in substantially side by side relationship.

32. The electrical connector as recited in claim 31, wherein the connector is a right angle connector.

33. The electrical connector as recited in claim 31, wherein said support is a housing.

34. An electrical connector as in claim 31, wherein each module includes a circuit board and a cover element for holding the circuit board, said cover includes retaining structure for retaining flexible conductors adjacent a region of the circuit board.

35. The module of claim 34, wherein the retaining structure is integrally formed with the cover.

36. An electrical connector comprising:

a housing; and a circuit module mountable in the housing, comprising:

a circuit substrate;

a pair of substantially parallel signal conductors, each residing on opposite sides of said circuit substrate and extending from a first region of the module to a second region of the module; and at least two electrical contact terminals, each terminal being electrically connected to one of the signal conductors in the first region, said signal conductors being arranged substantially symmetrically about a longitudinal plane of the module, whereby the conductors constitute substantial mirror-images of each other about said longitudinal plane.

37. An electrical connector for relaying differential pairs of signals, comprising:

a plurality of modules, each module having a plurality of signal conductors; said signal conductors being arranged substantially symmetrically about a longitudinal plane of the plurality of modules, whereby the conductors constitute substantial mirror-images of each other about said longitudinal plane, and a connector body made of an insulating material which is adapted to receive said plurality of modules generally in a side-by-side arrangement;

wherein each signal conductor on each adjacent module defining one of a pair of differential pairs.

* * * * *